US010758043B2

(12) United States Patent
Pohlmann

(10) Patent No.: US 10,758,043 B2
(45) Date of Patent: Sep. 1, 2020

(54) SELF-RETRACTING AND DAMPING DEVICE FOR A DRAWER ELEMENT, AND PIECE OF FURNITURE OR DOMESTIC APPLIANCE HAVING AT LEAST ONE DRAWER ELEMENT

(71) Applicant: PAUL HETTICH GMBH & CO. KG, Kirchlengern (DE)

(72) Inventor: Volker Pohlmann, Herford (DE)

(73) Assignee: PAUL HETTICH GmbH & CO. KG, Kirchlengern (DE)

( * ) Notice: Subject to any disclaimer, the term of this patent is extended or adjusted under 35 U.S.C. 154(b) by 0 days.

(21) Appl. No.: 16/329,850

(22) PCT Filed: Aug. 31, 2017

(86) PCT No.: PCT/EP2017/071846
§ 371 (c)(1),
(2) Date: Mar. 1, 2019

(87) PCT Pub. No.: WO2018/041937
PCT Pub. Date: Mar. 8, 2018

(65) Prior Publication Data

US 2019/0239644 A1 Aug. 8, 2019

(30) Foreign Application Priority Data

Sep. 2, 2016 (DE) ..... 10 2016 116 449

(51) Int. Cl.
*A47B 88/467* (2017.01)

(52) U.S. Cl.
CPC ..... *A47B 88/467* (2017.01)

(58) Field of Classification Search
CPC ..... A47B 88/467; A47B 2088/4675; A47B 88/477; A47B 88/463; A47B 2210/0094;
(Continued)

(56) References Cited

U.S. PATENT DOCUMENTS 8,905,498 B2 * 12/2014 Hammerle ..... A47B 88/40 312/333
9,775,434 B2 * 10/2017 Flogaus ..... A47B 88/467
(Continued)

FOREIGN PATENT DOCUMENTS

DE 202005015529 U1 2/2007
DE 102013114309 A1 6/2015
(Continued)

OTHER PUBLICATIONS

International Search report dated Dec. 15, 2017 in related/corresponding International Application No. PCT/EP2017/071846.
(Continued)

*Primary Examiner* — Hiwot E Tefera
(74) *Attorney, Agent, or Firm* — Patent Portfolio Builders PLLC

(57) ABSTRACT

A self-retracting and damping device for a drawer element, having a first driver, which has a first driver fork for the engagement of an external activator and is guided in a displaceable manner in a first guide curve, and having a second driver, which is guided in a displaceable manner in a second guide curve. One of the drivers is coupled to a damping element and the other driver is coupled to an energy store. The two drivers are coupled to one another in part. The first driver is coupled to the energy store and the second driver is coupled to the damping element. In a first part of a retracting movement, the energy store and the damping element act on the external activator and, in a second part of the retracting movement, only the energy store acts on the external activator.

14 Claims, 20 Drawing Sheets

(58) Field of Classification Search
CPC ..... A47B 88/473; A47B 2210/0091; A47B 88/47; A47B 2210/0056
USPC ..... 312/319.1, 333, 330.1, 334.44; 16/49, 16/51, 66, 71, 72
See application file for complete search history.

(56) References Cited

U.S. PATENT DOCUMENTS

2004/0237252 A1* 12/2004 Hoshide ..... E05F 1/16 16/72
2006/0113169 A1* 6/2006 Leon ..... A47B 88/467 200/5 R
2007/0132346 A1* 6/2007 Huang ..... A47B 88/467 312/333
2007/0222346 A1* 9/2007 Kleinsasser ..... A47B 88/467 312/205
2007/0278917 A1* 12/2007 Yang ..... A47B 88/467 312/330.1
2009/0273129 A1* 11/2009 Zimmer ..... E05F 1/16 267/170
2011/0041284 A1* 2/2011 Kimura ..... E05F 1/16 16/49
2011/0080080 A1* 4/2011 Zimmer ..... A47B 88/467 312/319.1
2012/0002907 A1* 1/2012 Rehage ..... A47B 88/467 384/20
2014/0189979 A1* 7/2014 Rioja Calvo ..... E05F 1/16 16/80
2014/0294328 A1* 10/2014 Pecar ..... A47B 88/40 384/20
2014/0300262 A1* 10/2014 Flogaus ..... E05F 1/16 312/319.1
2014/0327351 A1* 11/2014 Chung ..... A47B 88/463 312/333
2015/0374125 A1* 12/2015 Goetz ..... A47B 88/463 312/319.1
2016/0076288 A1* 3/2016 Bantle ..... E05F 1/16 49/417
2017/0079430 A1* 3/2017 Goetz ..... A47B 88/477
2019/0008276 A1 1/2019 Goetz

FOREIGN PATENT DOCUMENTS

KR 20120002183 A 1/2012
WO 2010143352 A1 12/2010
WO 2017173469 A2 10/2017

OTHER PUBLICATIONS

Search Report created on Sep. 19, 2017 in related/corresponding DE Application No. 10 2016 116 449.6.
Written Opinion dated Dec. 15, 2017 in related/corresponding International Application No. PCT/EP2017/071846.

* cited by examiner

SELF-RETRACTING AND DAMPING DEVICE FOR A DRAWER ELEMENT, AND PIECE OF FURNITURE OR DOMESTIC APPLIANCE HAVING AT LEAST ONE DRAWER ELEMENT

BACKGROUND AND SUMMARY OF THE INVENTION

Exemplary embodiments of the invention relate to a self-retracting and damping device for a drawer element having a first driver, which has a first driver fork for the engagement of an external activator and which is displaceably guided in a first guide curve, and having a second driver, which is displaceably guided in a second guide curve. In this case, one of the drivers is coupled to a damping element and the other of the drivers is coupled to an energy storage unit, wherein the two drivers are coupled together in part. Exemplary embodiments of the invention also relate to a piece of furniture or a domestic appliance with at least one drawer element.

Self-retracting and damping devices are used for a damped active retraction of a sliding element into a retracted or an extended end position. Suitable sliding elements are, for example, movable furniture components or movable elements of a domestic appliance such as a drawer, an appliance carrier or a food carrier. The sliding elements are usually mounted on a guide device, such as a pull-out guide, so that they can be pulled out of a furniture body or an interior space of the domestic appliance. Domestic appliances in this sense are in particular refrigeration appliances, for example refrigerators or freezers, but also cooking appliances such as ovens or steam cookers, and dishwashers. Sliding elements are also movable doors, furniture doors as well as living room doors or room dividers with folding doors, which are mounted on a guide rail via guide elements. Alternatively, the sliding elements can also be used in workshop trolleys, in the medical sector or in pharmacy cabinets.

For comfortable operation of the sliding elements, the self-retracting and damping devices mentioned above are provided, which dampen a movement of the sliding element into an end position and pull the sliding element into this end position. For this purpose, at least one external activator is mounted either on the moving sliding element and/or on the guide device guiding this element, which activator is connected to a driver of the self-retracting and damping device correspondingly on the moving sliding element or on the guide device guiding this element, so that accelerating and/or decelerating forces can be transmitted between the self-retracting and damping device and the sliding element. The self-retracting and damping device may be integrated into the guide device or mounted as a separate unit within the furniture body or the interior space of the domestic appliance to couple with the external activator.

The self-retracting and damping device may be associated with the fixed part of the furniture item, domestic appliance or guide, in which case the external activator is located on the movable drawer element or on the movable part of the guide. However, the arrangement may also be reversed in such a way that the self-retracting and damping device is located on the movable drawer element or on the movable part of the guide, while the external activator is associated with the fixed part of the furniture, domestic appliance or guide.

Self-retracting and damping devices are known that have a driver that is displaceably guided in a guide curve and which is coupled to both a damping element and an energy storage unit. In this case, damping forces and the self-retracting forces applied by the energy storage unit act over the same displacement path of the one driver, unless the damping element provides damping only for part of the displacement path due to its internal structure.

In addition, a self-retracting and damping device is known from the publication KR 2012 000 2183 A, in which two separate drivers are each guided in their own guide curve. A first driver is designed for coupling with the external activator. This driver is guided in a longer guide curve than the second driver, which is coupled to a self-retracting spring. In a first movement section, only the first driver moves with the activator and dampens the movement of the drawer element in this movement section. After this first movement section, an internal driver arranged on the first driver engages in a driver fork of the second driver so that the first and second drivers are coupled together, wherein the external activator still engages in the driver fork of the first driver. This is followed by a second movement section in which damping takes place together with a self-retracting mechanism until the drawer element has reached the retracted end position.

In some applications, in particular for drawer elements of cooling appliances or also for drawer elements which engage in a locking element in their fully retracted position, a movement sequence of a self-retracting and damping device is advantageous in which the greatest possible forces act at the end of the retraction path in order to achieve the safest possible retraction into the fully retracted end position of the drawer element. Self-retracting and damping devices cannot do this according to the prior art described. This also applies to the fully extended end position if, for example, a sliding element designed as a drawer, device carrier or food carrier is unloaded or loaded in this end position. Then it is advantageous that the sliding element remains safely in the fully extended end position. In order to achieve this goal, separate mechanisms with additional components are necessary in the prior art.

Exemplary embodiments are, therefore, directed to a self-retracting and damping device providing the greatest possible self-retracting forces when traveling into the fully retracted and/or extended position of the connected drawer element in order to ensure retraction into the end position of the drawer element. Exemplary embodiments are also directed to a piece of furniture or domestic appliance with such a self-retracting and damping device.

A self-retracting and damping device according to the invention is characterized in that the first driver is coupled to the energy storage unit and the second driver is coupled to the damping element, wherein in a first section of a retracting movement the energy storage unit and the damping element act on the external activator and in a second section of the retracting movement only the energy storage unit acts on the external activator.

As a result, a coupled drawer element experiences a damped self-retracting movement in the first section when it is pulled into the end position. At the end of the first section, the coupling between the first and second drivers is released and the remaining second section of the displacement path of the self-retracting and damping device occurs in a non-damped manner, so that only the self-retracting forces act. This second section, in which the self-retracting and damping device no longer acts in a damping manner, leads to a safer reaching of the end position for the coupled drawer element. At the end of the second section, the first driver and thus the external activator are retracted as far as possible into the self-retracting and damping device.

One reason for this lies in the friction losses switched off in the second section, which the damping element itself introduces into the motion sequence. Another reason is that the damping element keeps the retraction speed low, which is basically desired, but especially in the last section of the self-retraction there is a danger that the drawer element will move from a sliding or rolling friction in its pull-out guide into a static friction that interrupts the movement.

The slightly increased retraction speed, due to the decoupling of the damping element in the second section of the displacement path, prevents the stop of the drawer element by the commencement of static friction instead of rolling or sliding friction when guiding the drawer element. With the self-retracting and damping device according to the invention, the self-retracting function and the damping function are each assigned to one of the drivers. The coupling between the drivers can be clearly determined mechanically by design. In this way it is possible to specify the ratio of the length of the first or second section to the total travel distance.

The preferred length of the second section is between 20% and 40% and in particular between 30% and 35% of the total displacement of the first carrier. The total displacement path corresponds to the sum of the length of the first and second sections. In typical applications, the specified conditions represent a good compromise between sufficient damping and safe insertion into the end position.

In an advantageous embodiment of the self-retracting and damping device, the second driver has a second driver fork to interact with an internal activator arranged on the first driver to couple the two drivers together. In the first section of the retraction movement, the first driver with its internal activator preferably engages in the second driver fork of the second driver in order to couple the two drivers. At the end of the first section, the second driver is guided through the second guide curve in such a way that the coupling between the two drivers is eliminated in the second section of the displacement path. This can be implemented in a constructively simple and reliable manner in that the second guide curve has an angled end section in the transition area between the first and second sections, with the angled end section pointing away from the first guide curve. A retraction of the second driver (or part of the second driver) into the angled end section moves the driver fork at least on one side away from the internal activator, which is then released and can move further into the second section of the retraction movement.

In another advantageous embodiment of the self-retracting and damping device, a detent means is arranged in the area of the angled end section of the second guide curve, which fixes the second driver in the end section. This prevents the second driver from slipping back out of the angled end section, especially if the angled end section is pointing downwards due to gravity.

In a further advantageous embodiment of the self-retracting and damping device, the energy storage unit has at least one tension spring and/or at least one compression spring. The above springs can also be combined, for example by the energy storage unit having a tension spring and a compression spring which are connected to each other via a coupling carriage which is guided in a sliding manner on a housing of the self-retracting and damping device. This combination enables a long displacement path of the first driver with a short installation length of the energy storage unit.

In a further advantageous embodiment of the self-retracting and damping device, the damping element is a linear damper. In principle, other types of damping elements, e.g., a rotary damper, can also be used, but a linear damper is advantageous for a linear displacement movement of the second driver.

In a further advantageous embodiment of the self-retracting and damping device, the second guide curve has at least one evasion section running obliquely to the main guide direction to enable an evasive movement of the second driver in a direction transverse to the main guide direction. Due to transport or installation, a situation may occur in which the internal activator of the first driver is not positioned in the second driver fork, although the first driver is in the first section of the retraction movement. In order to be able to move the internal activator back into the second driver fork, the evasion sections are provided in the guide curve. Preferably, the second driver has a spring lance protruding into its travel, which exerts a restoring force on the second driver during the evasive movement. This results in a resilient evasive movement. When the two drivers are correctly positioned again due to the evasive movement, the second driver springs back and the second driver fork grips the internal activator positively again to establish a coupling of the two drivers.

In a further advantageous embodiment of the self-retracting and damping device, at least one edge of the second guide curve is designed to be flexible in sections in order to enable an evasive movement of the second driver in a direction transverse to the main guide direction. This alternative embodiment also allows an evasive movement of the second driver in order to correct an incorrect positioning of the two drivers. If the second guide curve is formed in a wall of a housing of the self-retracting and damping device, compliance can be advantageously achieved by one or more incisions formed adjacent and preferably parallel to the second guide curve in the wall.

A piece of furniture or domestic appliance according to the invention having at least one drawer element is characterized in that it has at least one of the self-retracting and damping devices described above acting on the drawer element. In this case, the self-retracting and damping device can be stationary relative to a body of the furniture or domestic appliance and interact with an external activator connected to the drawer element. Alternatively, the self-retracting and damping device may be located on the drawer element and interact with a stationary external activator. This results in the advantages mentioned in connection with the self-retracting and damping device.

The self-retracting and damping device according to the invention can be used for any end positions of the drawer element. The particularly advantageous application serves to retract the drawer element into a retracted closed position within the piece of furniture or domestic appliance. In the same way, it is also possible to use the self-retracting and damping device to retract the drawer element into an open position, in which the drawer element is brought into its extended end position outside the furniture body or domestic appliance. For example, two or more self-retracting and damping devices can be combined to retract and dampen a drawer element in both the closed and open positions.

BRIEF DESCRIPTION OF THE DRAWING FIGURES

The invention will be explained in more detail below by reference to embodiment examples shown in the drawings, wherein:

FIGS. 1*a, b* show in each case an isometric representation of a first embodiment example of a self-retracting and damping device mounted on a body rail of a pull-out guide in different operating positions;

Figure 6A:
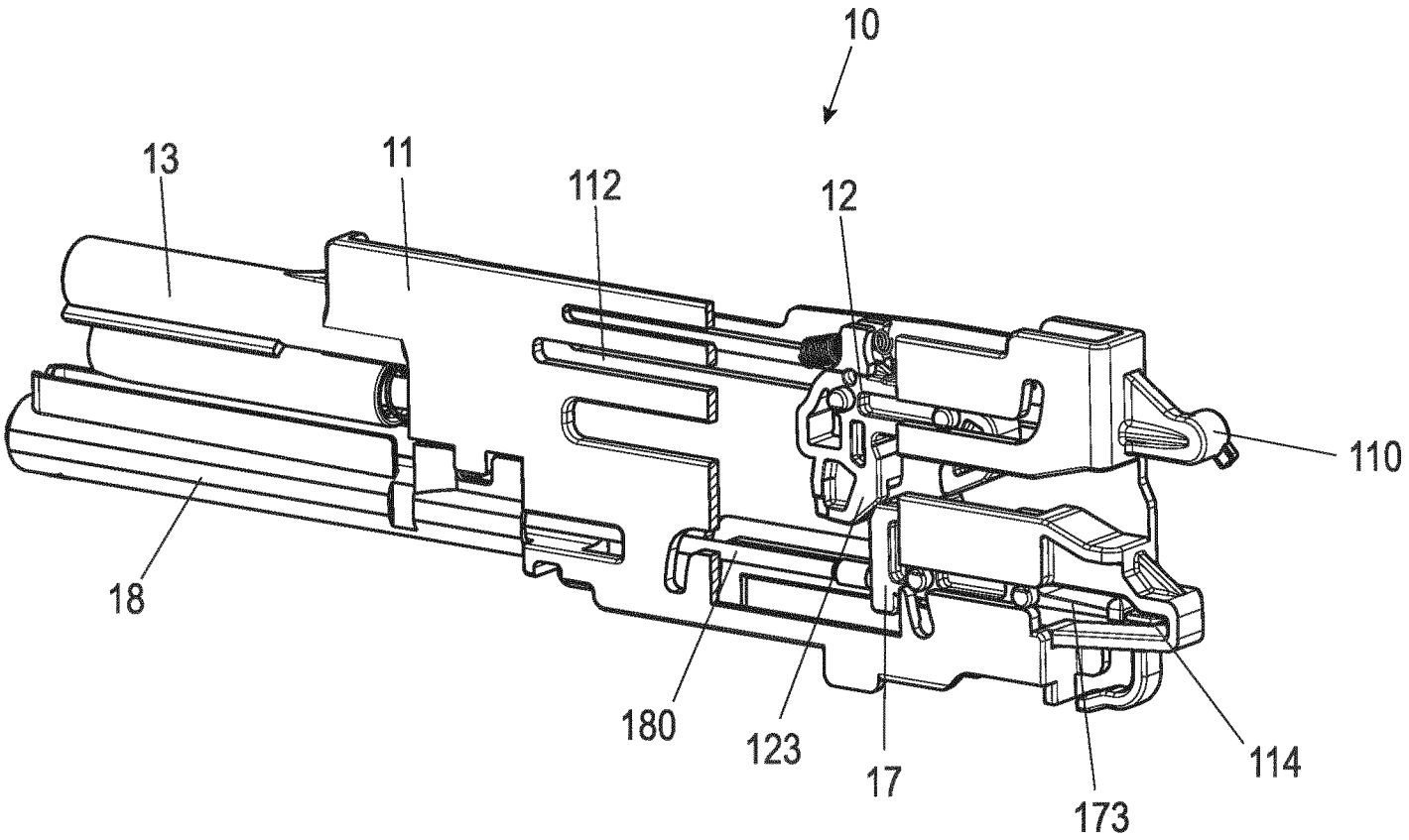
Figure 6B:
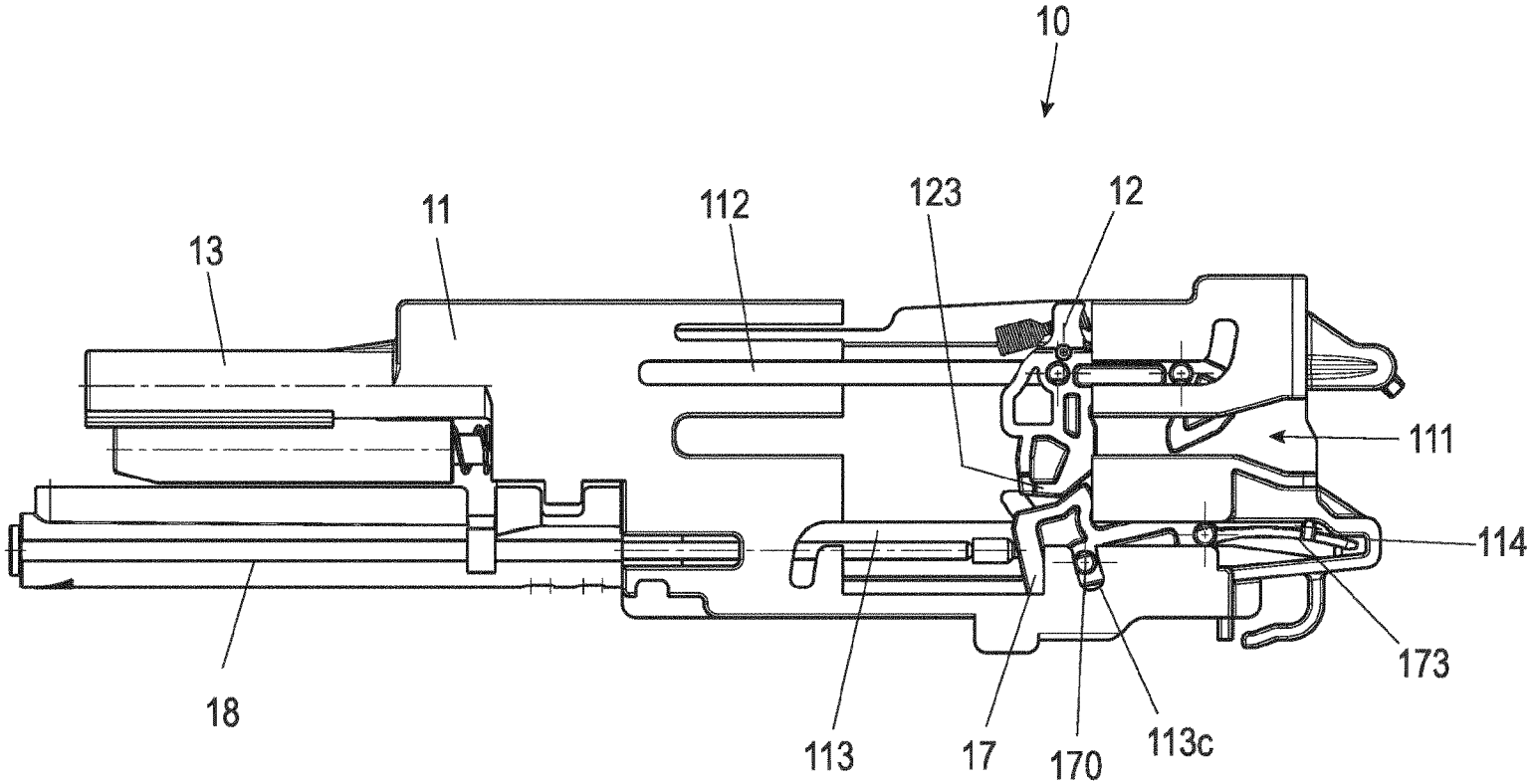
Figure 6C:
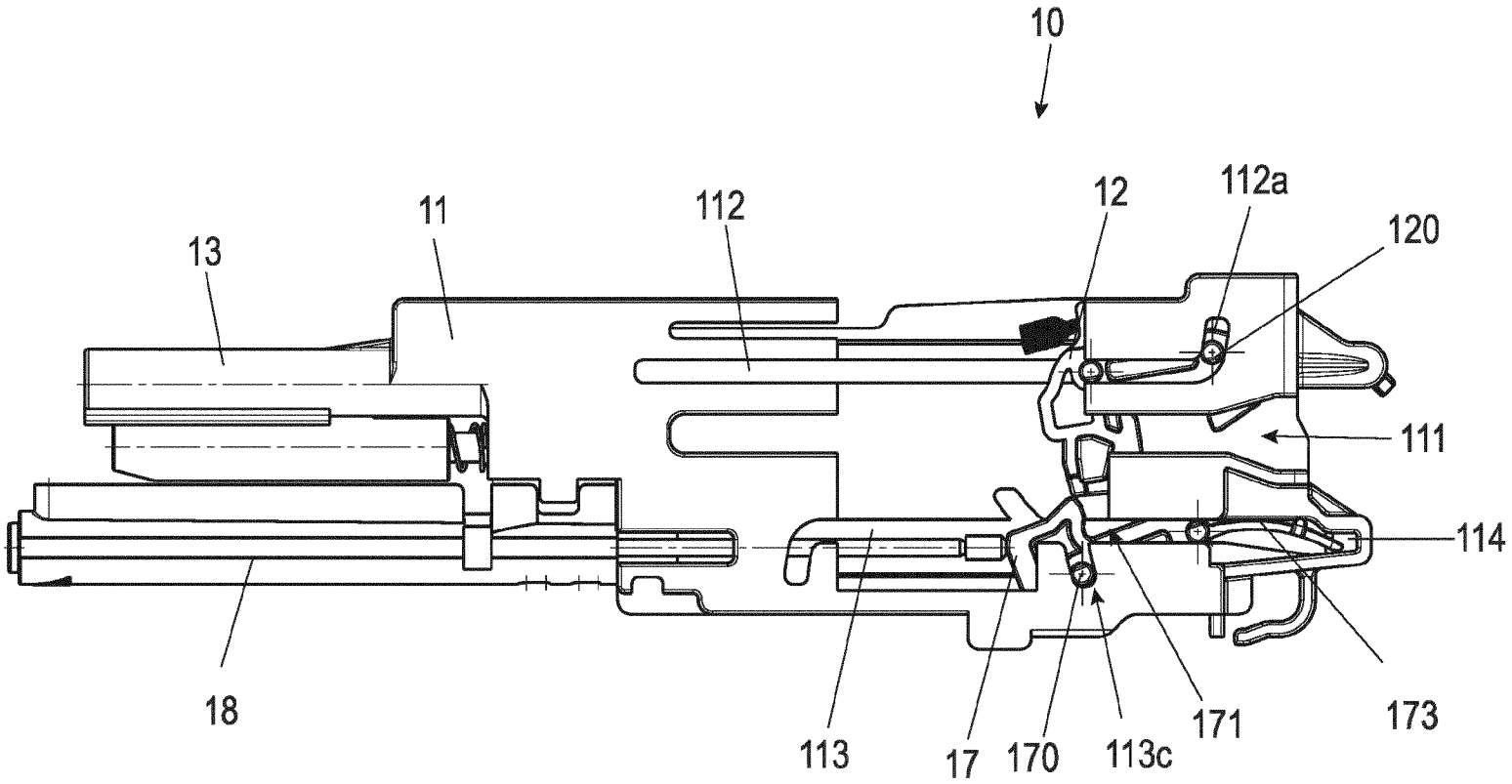
Figure 7A:
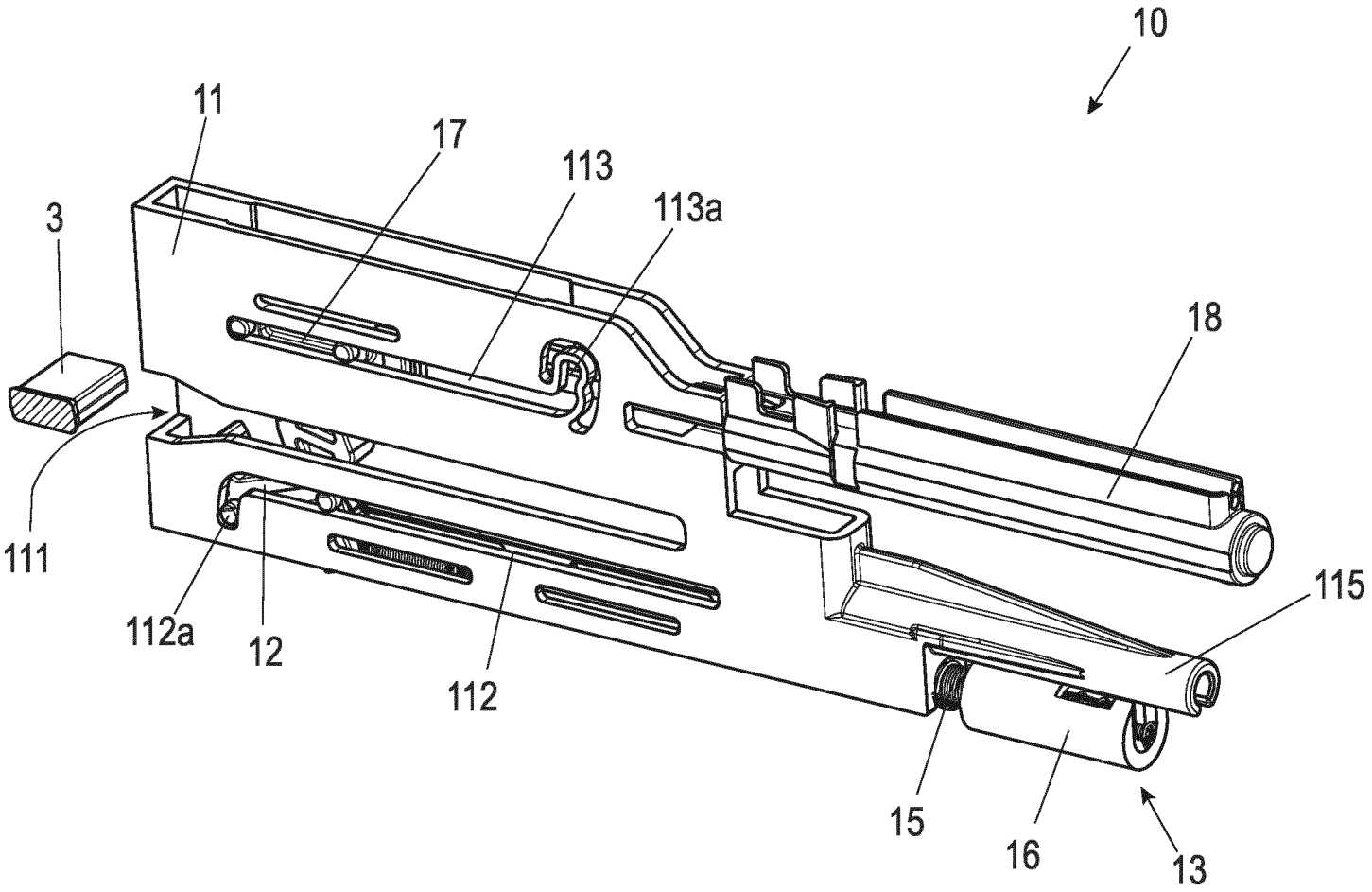
Figure 7B:
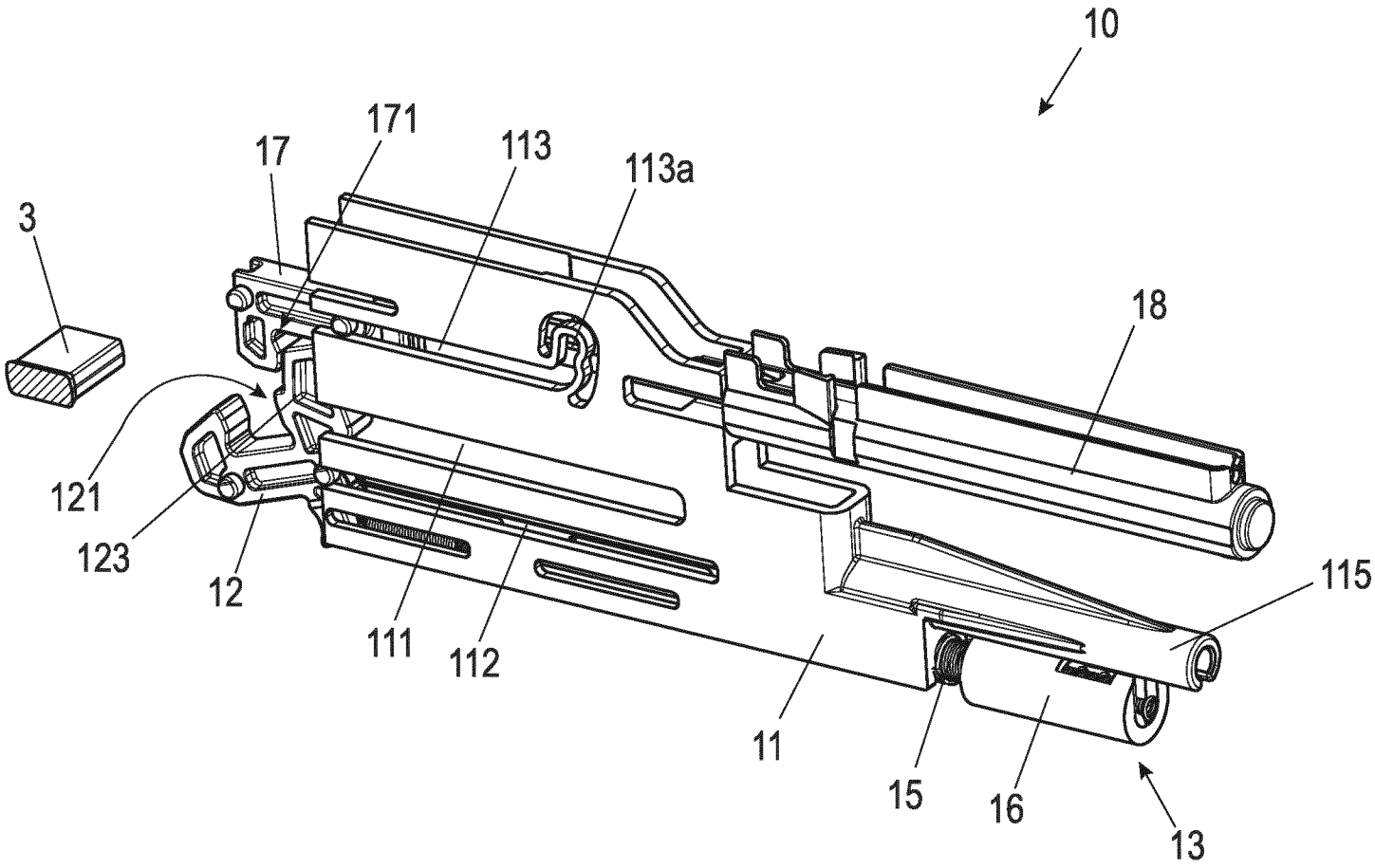
Figure 8A:
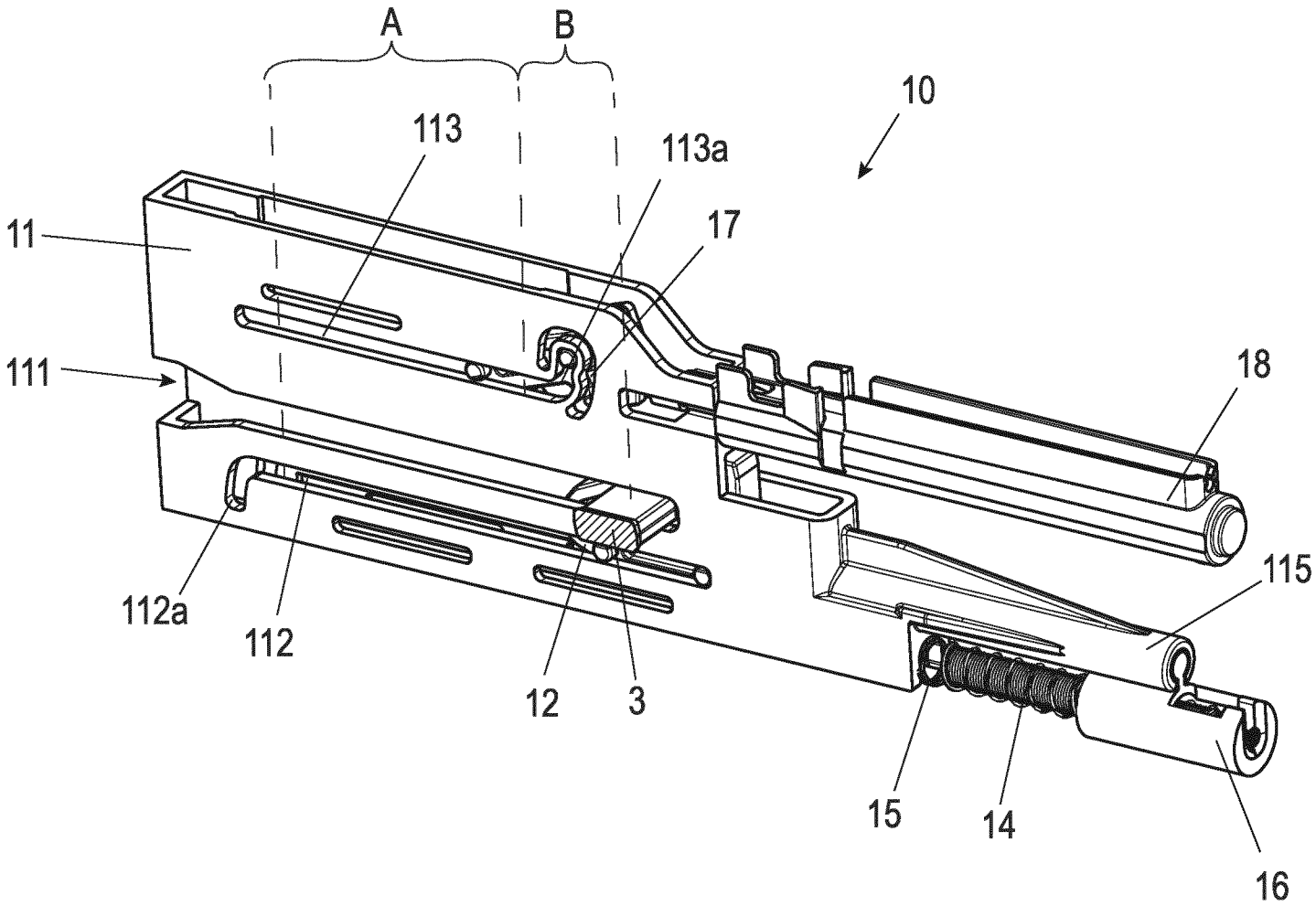
Figure 9:
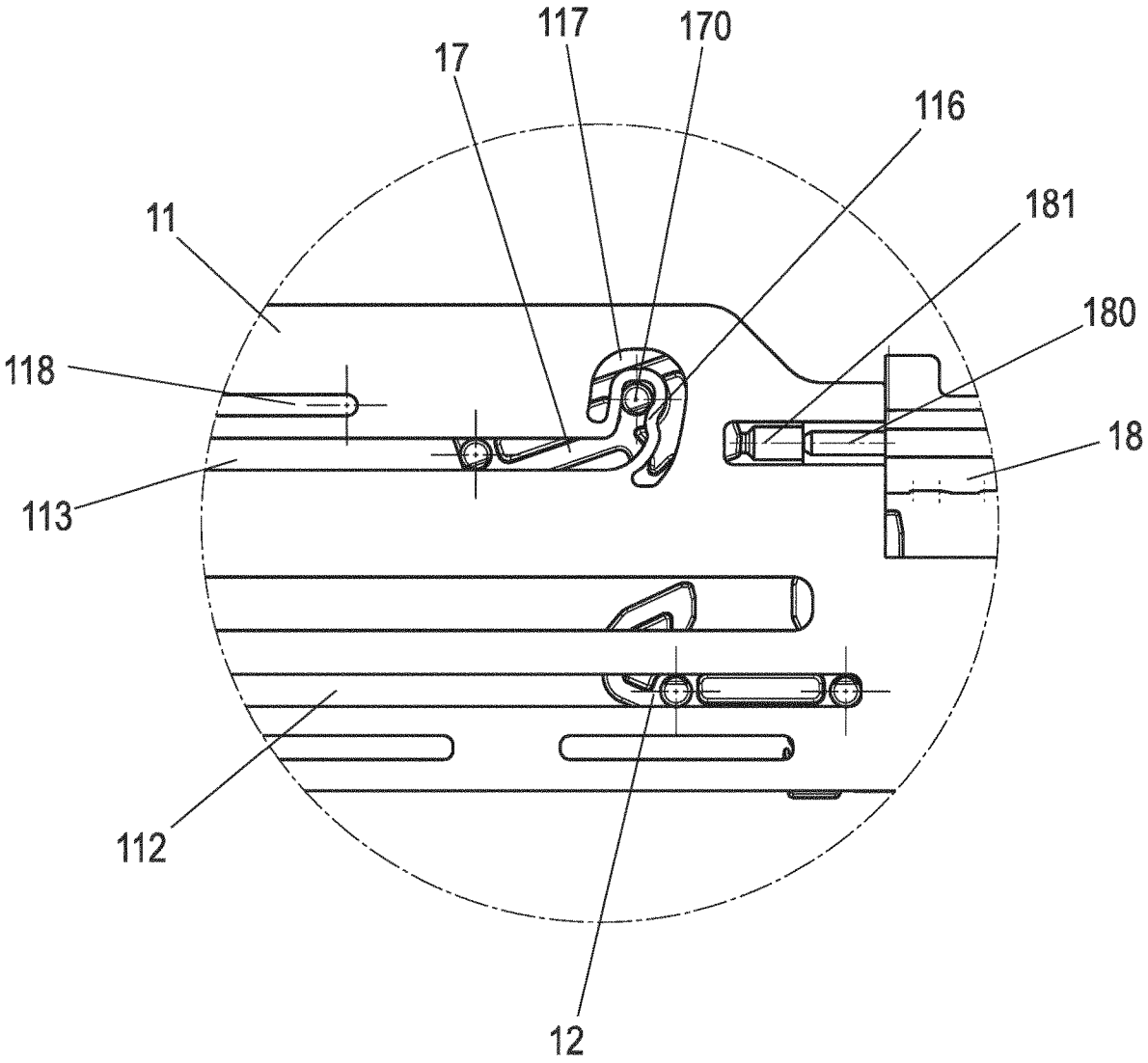
Figure 10:
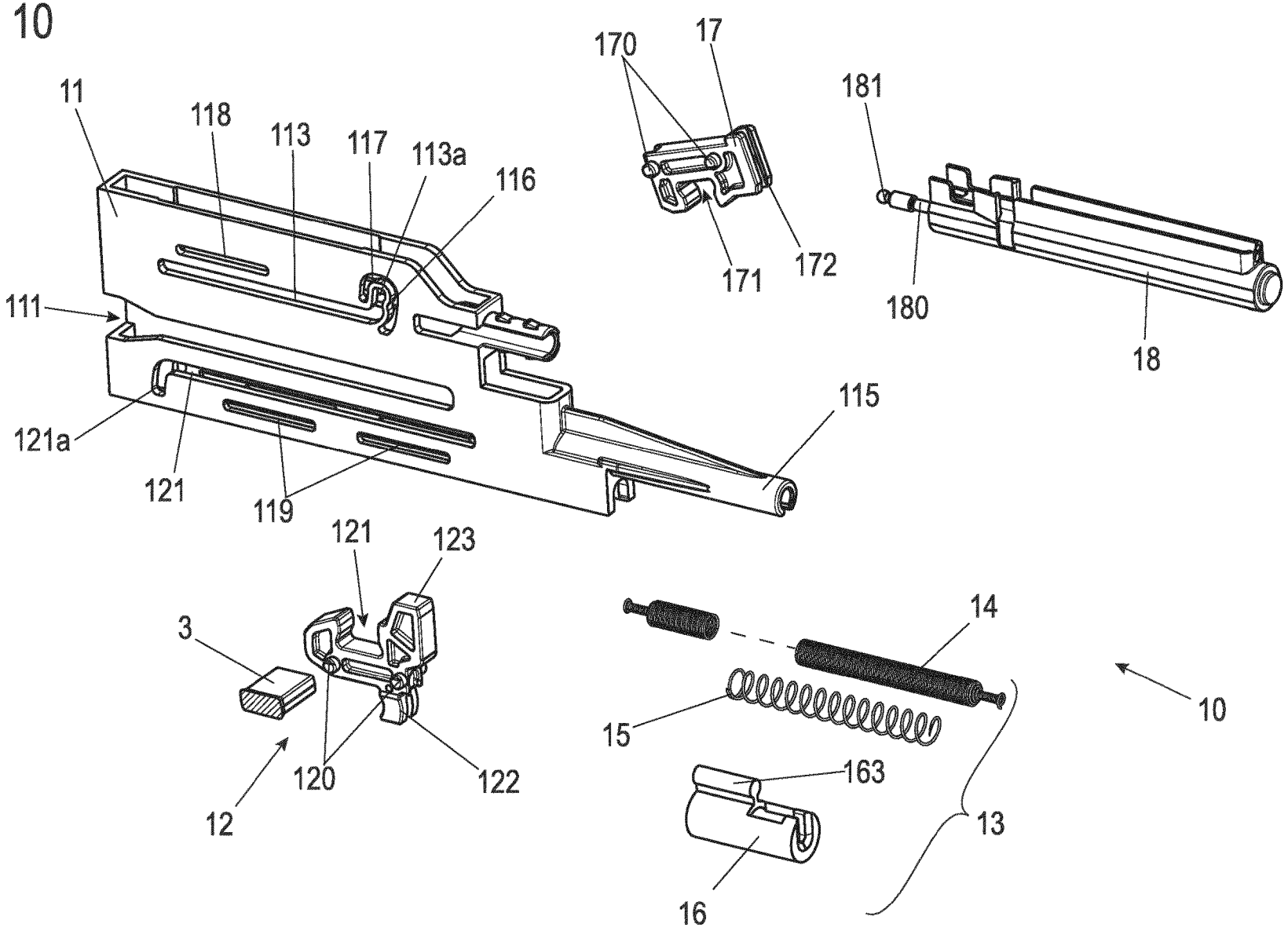
Figure 11:
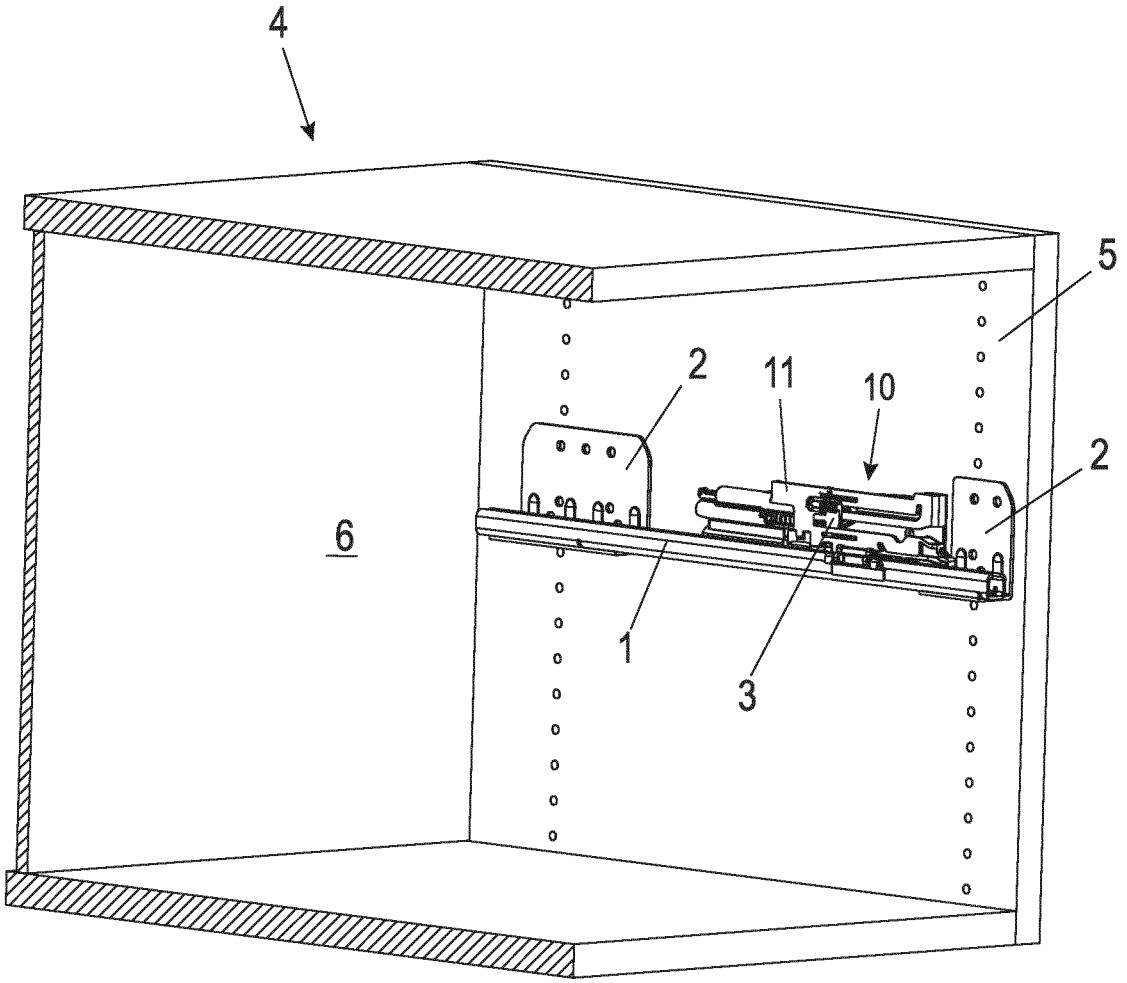
Figure 12:
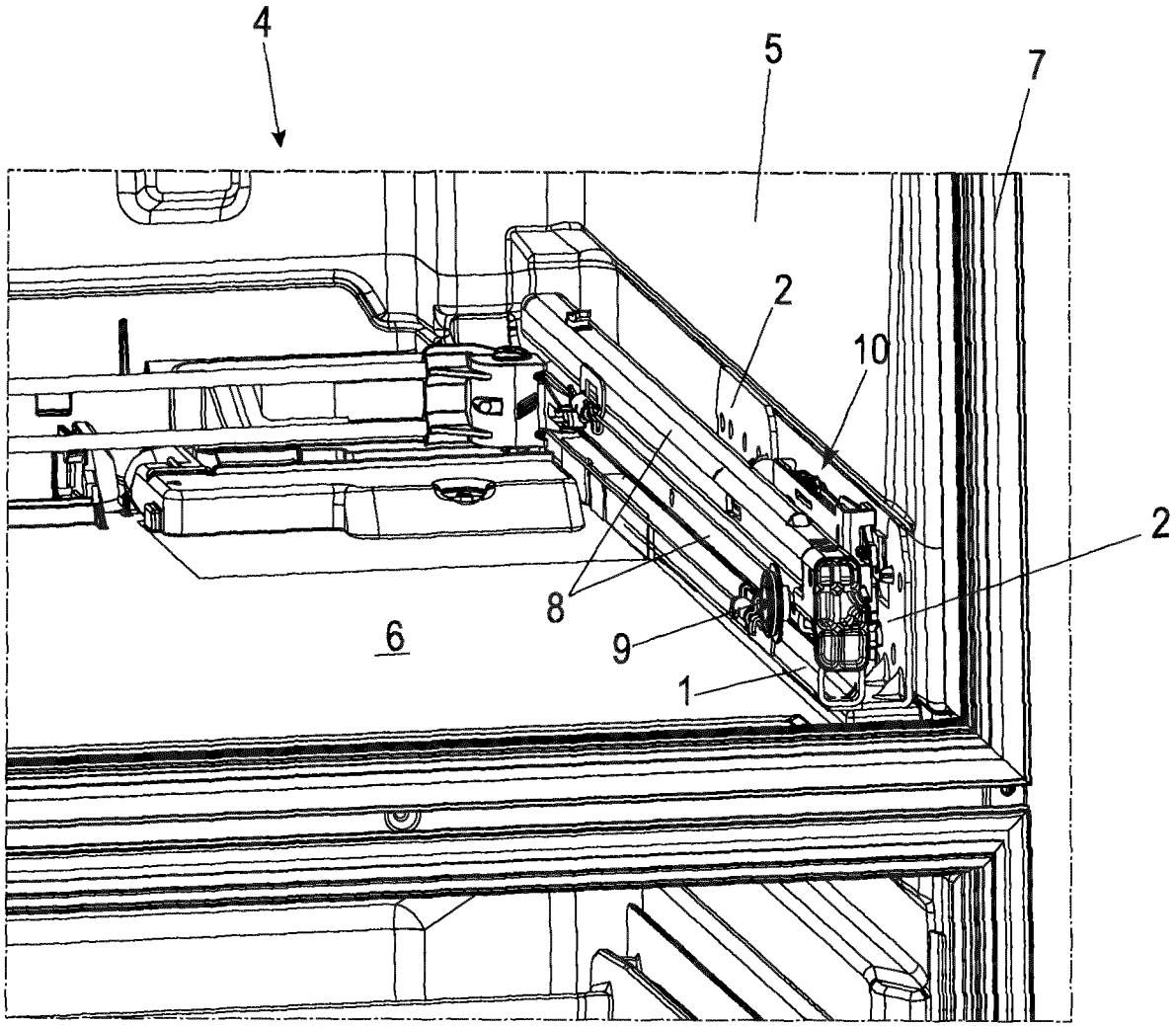

FIGS. 5*a-d* show in each case an isometric representation of the self-retracting and damping device of the first embodiment example in various operating positions with the housing partially cut open;

FIGS. 6*a-c* show in each case an isometric representation or a side view of the self-retracting and damping device of the first embodiment example in various operating positions with the housing partially cut open;

FIG. 7*a* shows an isometric representation of a second embodiment example of a self-retracting and damping device in an operating position;

FIG. 7*b* shows a representation analogous to FIG. 7*a* with the housing partially cut open;

FIGS. 8*a, b* show in each case an isometric representation of the self-retracting and damping device of the second embodiment example analogous to FIGS. 7*a, b* in a further operating position;

FIG. 9 shows a section from FIG. 8*a* in a side view;

FIG. 10 shows the self-retracting and damping device of the second embodiment example in an isometric exploded view;

FIG. 11 shows an embodiment example of a piece of furniture with a pull-out guide and a self-retracting and damping device in an isometric sectional drawing; and FIG. 12 shows an isometric partial view of a refrigeration appliance with a pull-out guide and a self-retracting and damping device.

DETAILED DESCRIPTION

Figure 1A:
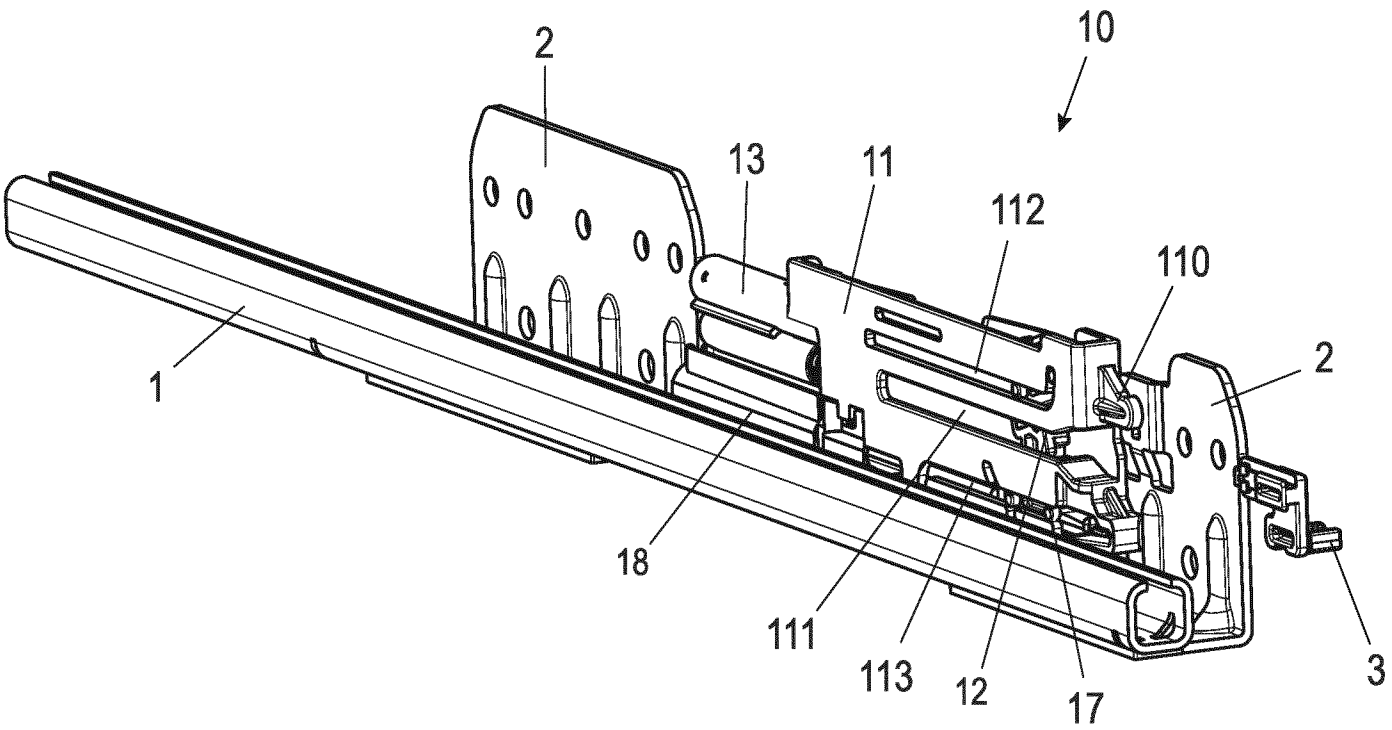
Figure 1B:
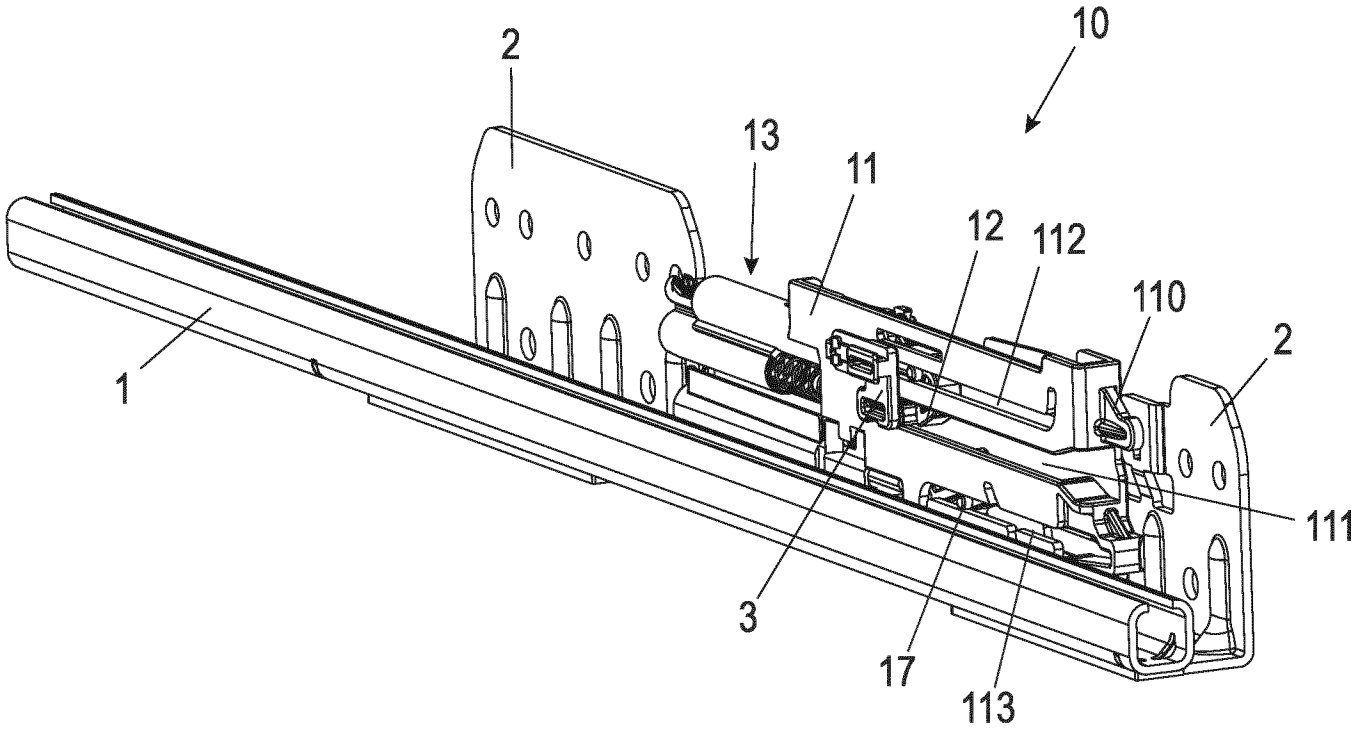
Figure 2:
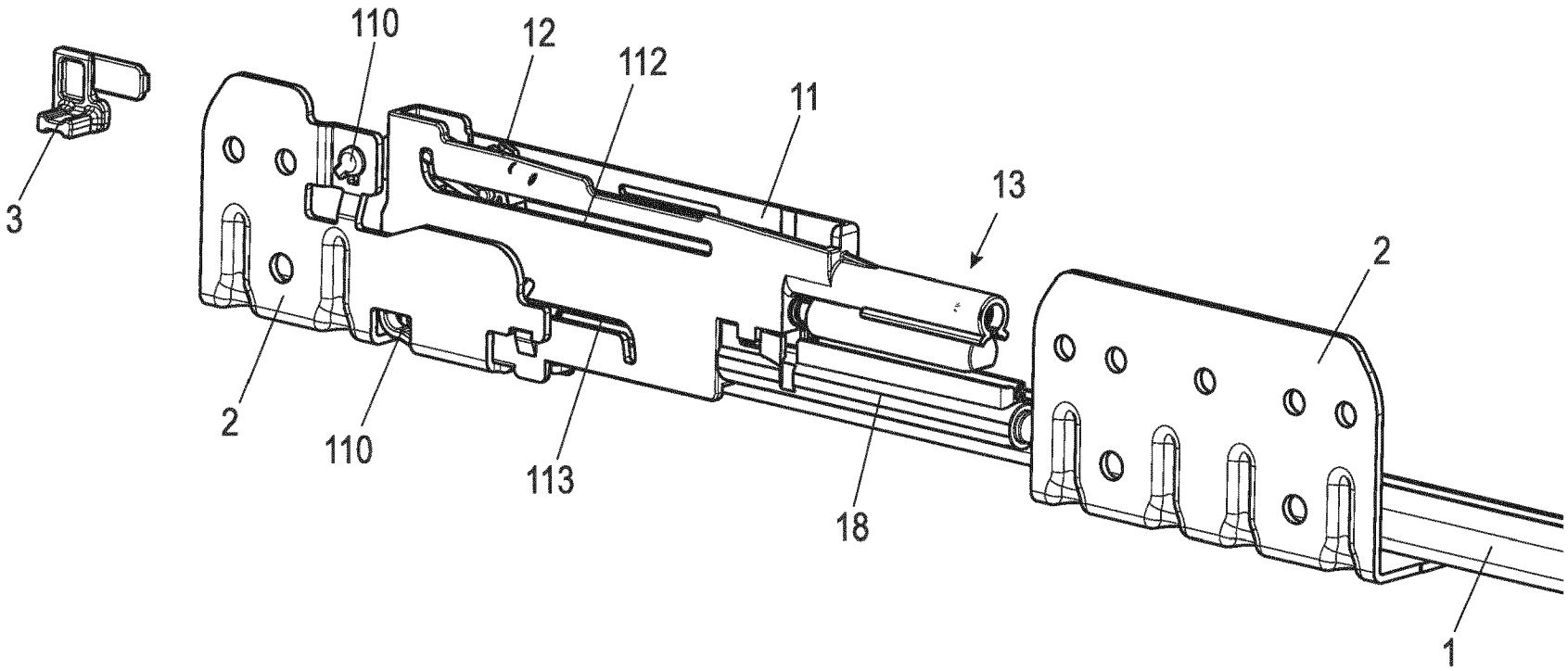
FIG. 2 shows a rear view of the arrangement according to FIG. 1*a;*

FIGS. 1*a*, 1*b* and 2 show a first embodiment example of a self-retracting and damping device 10 mounted on a pull-out guide for a drawer element. A body rail 1 with mounting brackets 2 is shown from the pull-out guide. For reasons of clarity, a running rail mounted in this sliding bearing relative to body rail 1 is not shown. An external activator 3 is attached to such a running rail or to a drawer element connected to this running rail and thus moves with the running rail or drawer element.

FIG. 1*a* shows an isometric oblique view of the arrangement of body rail 1 and self-retracting and damping device 10 in a state corresponding to a partially extended drawer element. Accordingly, the external activator 3 is not in contact with the self-retracting and damping device 10.

FIG. 1*b* shows the self-retracting and damping device 10 with gripped and fully retracted external activator 3 from the same viewing direction as FIG. 1*a*. This corresponds to a fully retracted state of the drawer element. FIG. 2 shows the condition according to FIG. 1*a* in a rear view, i.e., with a view to the mounting surfaces of the mounting brackets 2.

As FIGS. 1*a* and 1*b* show, the self-retracting and damping device 10 has a housing 11, which is preferably an integral injection-molded plastic element. Fastening means 110 are provided on the housing 11 with which the self-retracting and damping device 10 can be fastened without tools to one of the mounting brackets 2. In the longitudinal extension direction, at least one side of the housing 11 has an incision 111, into which the external activator 3 enters. Furthermore, guide curves 112, 113 are designed in the housing 11 for drivers arranged inside and mounted displaceably in the guide curves 112, 113.

In this embodiment example, the first guide curve 112 is formed in the upper part of the housing 11. A first driver 12 is guided in it. This first driver 12 is coupled to an energy storage unit 13. The second guide curve 113 is formed in the lower part of the housing 11. In this second guide curve 113, a second driver 17 is guided. This is connected to a damping element 18. Both guide curves 112 and 113 run parallel to each other with regard to their main direction of guidance.

Figure 3:
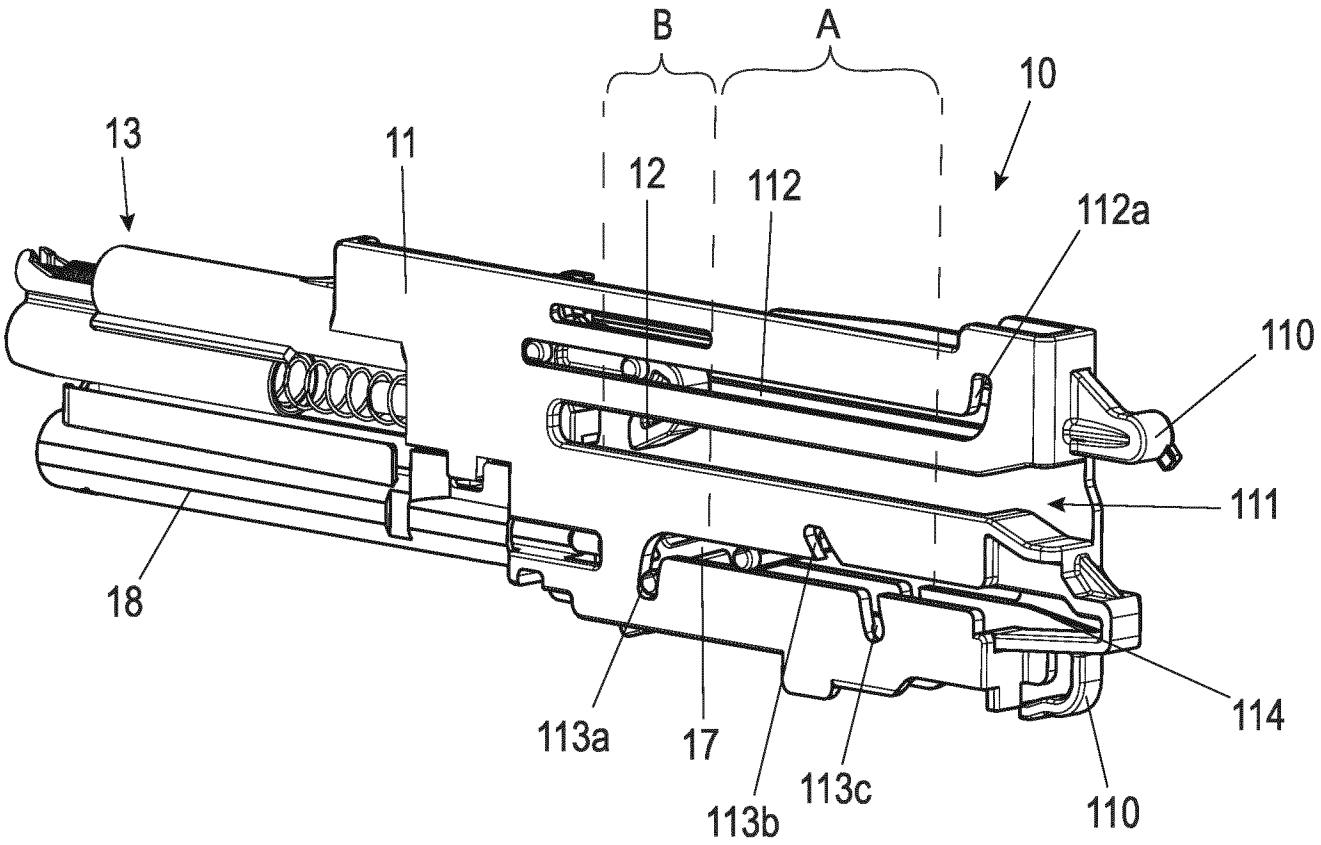
FIG. 3 shows the self-retracting and damping device of the first embodiment example in an isometric representation.
Figure 4:
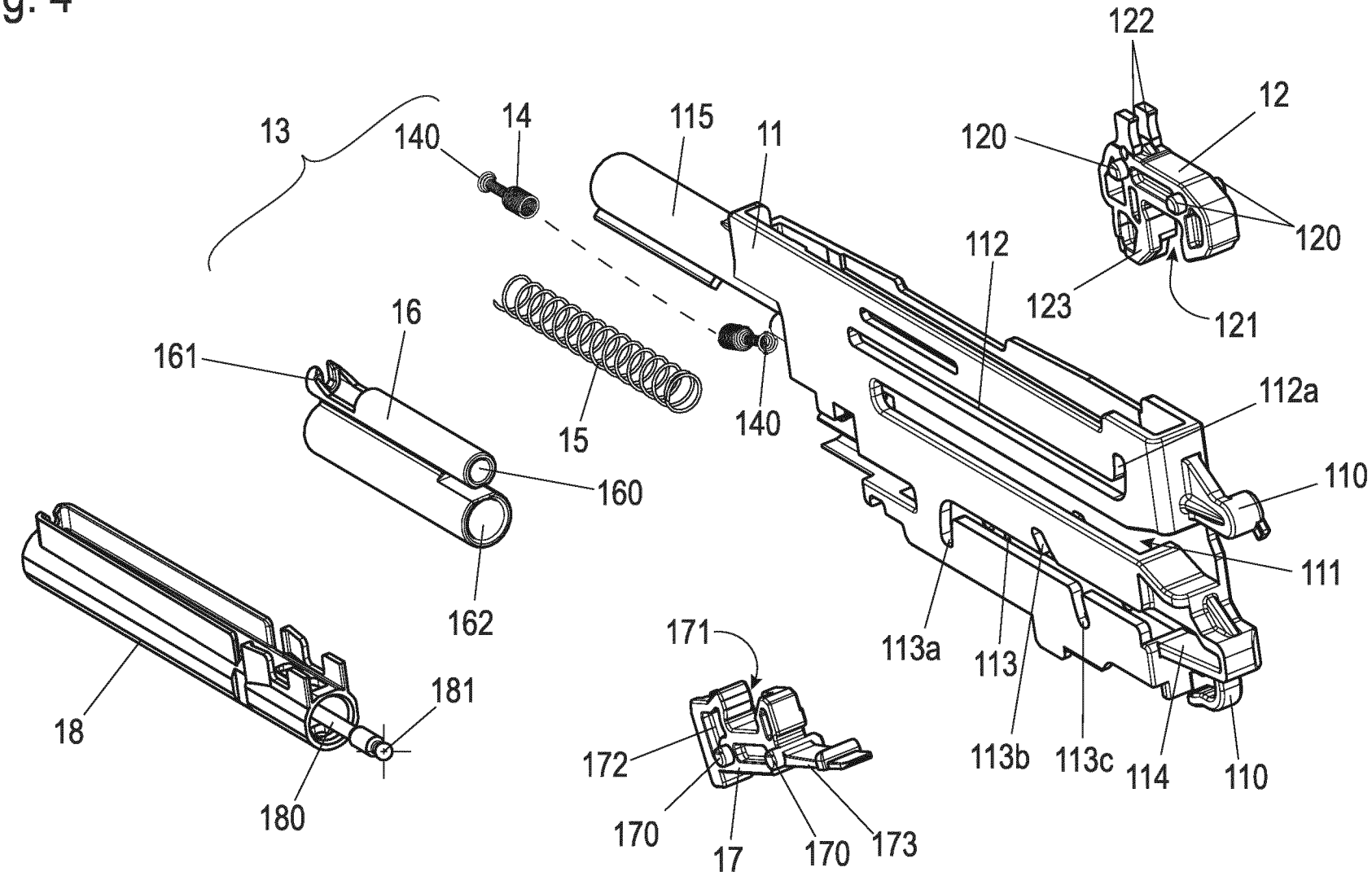
FIG. 4 shows the self-retracting and damping device according to FIG. 3 in an isometric explosion diagram.

FIGS. 3 and 4 show the self-retracting and damping device 10 of the first embodiment example separately from the body rail 1 in an isometric representation (FIG. 3) or an isometric explosion representation (FIG. 4). Details of the self-retracting and damping device 10 are first explained in more detail using these two figures. The motion sequence of the self-retracting and damping device 10 when retracting or extending the external activator 3 is subsequently described in more detail in connection with FIGS. 5*a* to 5*d* and 6*a* to 6*c*.

The first driver 12 has guide pins 120 protruding laterally, as well as a driver fork 121 open at the bottom. The external activator 3 engages in this. With the guide pins 120, the first driver 12 is guided in the first guide curves 112, which are formed opposite each other in each wall of the housing 11. The guide curve 112 is formed as a crutch curve, which has an upwardly facing bent end section 112*a* in its front area.

The front and rear designations refer to the direction of movement of the drawer element within the scope of the application. When closing the drawer element, the external activator 3 moves towards the front area of the self-retracting and damping device 10. Due to the upwardly facing angled end section 112*a*, the front area of the driver 120 lifts up in the maximum extended position, whereby the external activator 3 can be picked up when driving into the driver fork 121 or is released when driving out of it.

A fork 122 is arranged on the upper side of the driver 12, via which a connection to the energy storage unit 13 is made. In the present case, the energy storage unit 13 is realized by a combination of a tension spring 14 and a compression spring 15. For drawing reasons, the tension spring 14 is not reproduced over its entire length. It should be noted that, alternatively, the energy storage unit 13 can be composed of only one tension spring, only one compression spring and/or other combinations of one or more different springs. In the present combination of tension spring 14 and compression spring 15, the tension spring 14 with spring heads 140 is engaged for hooking into the fork 122 of the first driver 120 and on the other hand into a comparable fork 161 of a coupling carriage 16.

The coupling carriage 16 is essentially made up of two parallel tube sections arranged one above the other, the upper of which represents a tension spring guide 160, through which the tension spring 14 is guided. The lower tube section, closed at the rear, forms a compression spring receptacle 162 for the compression spring 15. The coupling carriage 16 is guided with its tension spring guide 160 in a downwardly open sleeve 115, which is formed in the rear area of the housing 11. The sleeve 115, which is open at the bottom, has webs at its opening which engage in the waist between the tension spring guide 160 and the compression spring receptacle 162. The combination of tension spring 14 and compression spring 15 leads to an advantageous linear spring behavior of the energy storage unit 13, even over a long guide travel of the first driver 120 with a relatively short installation length of the self-retracting and damping device 10.

The second driver 17 also has guide pins 170, with which it is guided in the second guide curve 113. This guide curve 113 is formed essentially parallel to the first guide curve 112. It is also a crutch curve with an angled end section 113*a*. In the middle area of the guide curve 113 there is a parking section 113*b* running diagonally upwards and an evasion section 113*c* running diagonally downwards, the function of which will be explained later.

At its front end, a spring lance 173 protruding in the direction of movement is arranged on the second driver 17, which also has protruding guide pins on its sides. The function of this spring lance 173 is also explained in more detail below. In the front area, the guide curve 113 leads into a pocket-shaped channel 114 into which the spring lance 173 can retract.

The two guide curves 112, 113 have different lengths, which lead to different travel paths of the two drivers 12, 17. In this case, the travel path of the first driver 12 is longer and represents the entire travel path of the retraction movement that the external activator 3 can perform within the self-retracting and damping device 10. In a first section A of the retracting movement, the second driver 17 moves together with the first driver 12. A second section B of the retracting movement is then only performed by the first driver 12. The length of the second section B in this example is about 33% of the total displacement path of the first driver 12. The total displacement path of the first driver 12 corresponds to the sum of the lengths of the first and second sections A, B.

The second driver 17 has a fork 171 open at the top, into which the internal activator 123 engages in order to couple both drivers 12, 17 to each other. In the rear area, a receptacle 172 is formed on the second driver 17 to couple this second driver 17 with the damping element 18. This is designed as a linearly operating cylinder damper (also called linear damper) with a piston rod 180, which at its end carries a ball head 181, which engages in the receptacle 172. The damping element 18 has unspecified fastening means with which it is preferably latched to the housing 11.

FIGS. 5*a*-5*d* show a sequence of four representations illustrating the self-retracting and damping process at different stages. The figures are isometric representations comparable with FIG. 3, but the area of the drivers 12, 17 is hidden from the housing 11 in order to provide an insight into the motion sequence of the drivers 12, 17 and their interaction. For reasons of clarity, not all elements in the figures are marked with reference numerals.

Figure 5A:
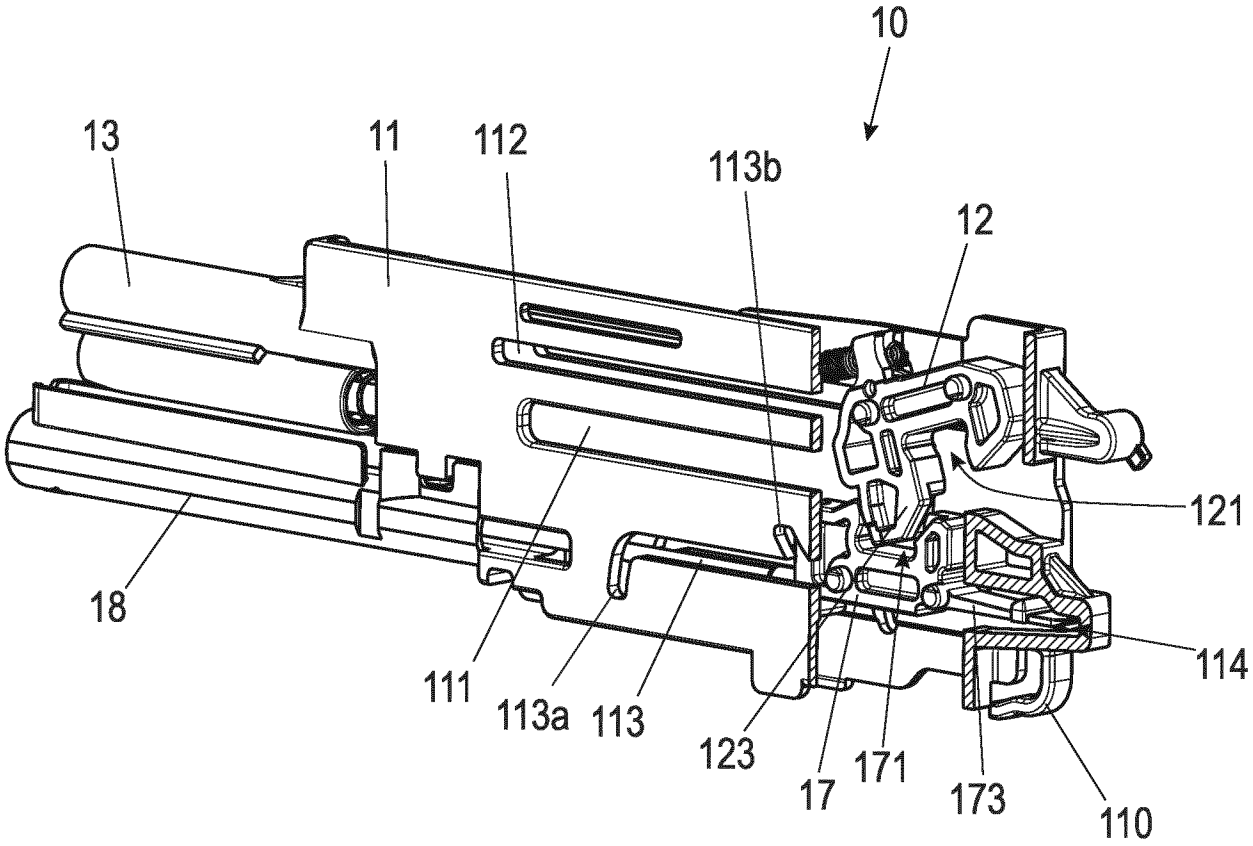

FIG. 5*a* first shows the rest position of the self-retracting and damping device 10 with the drawer element extended. Accordingly, both drivers 12, 17 are in their front position, with the energy storage unit 13 being maximally preloaded and the piston rod 180 of the damping element 18 being maximally extended. In this position, the first driver 12 in the front area is tilted upwards to accommodate an external activator (for example, the external activator 3 from FIGS. 1*a*, 1*b* and 2). The internal activator 123 of the first driver 12 is positioned in the driver fork 171 of the second driver 17. The two drivers 12, 17 are thus coupled to each other.

Figure 5B:
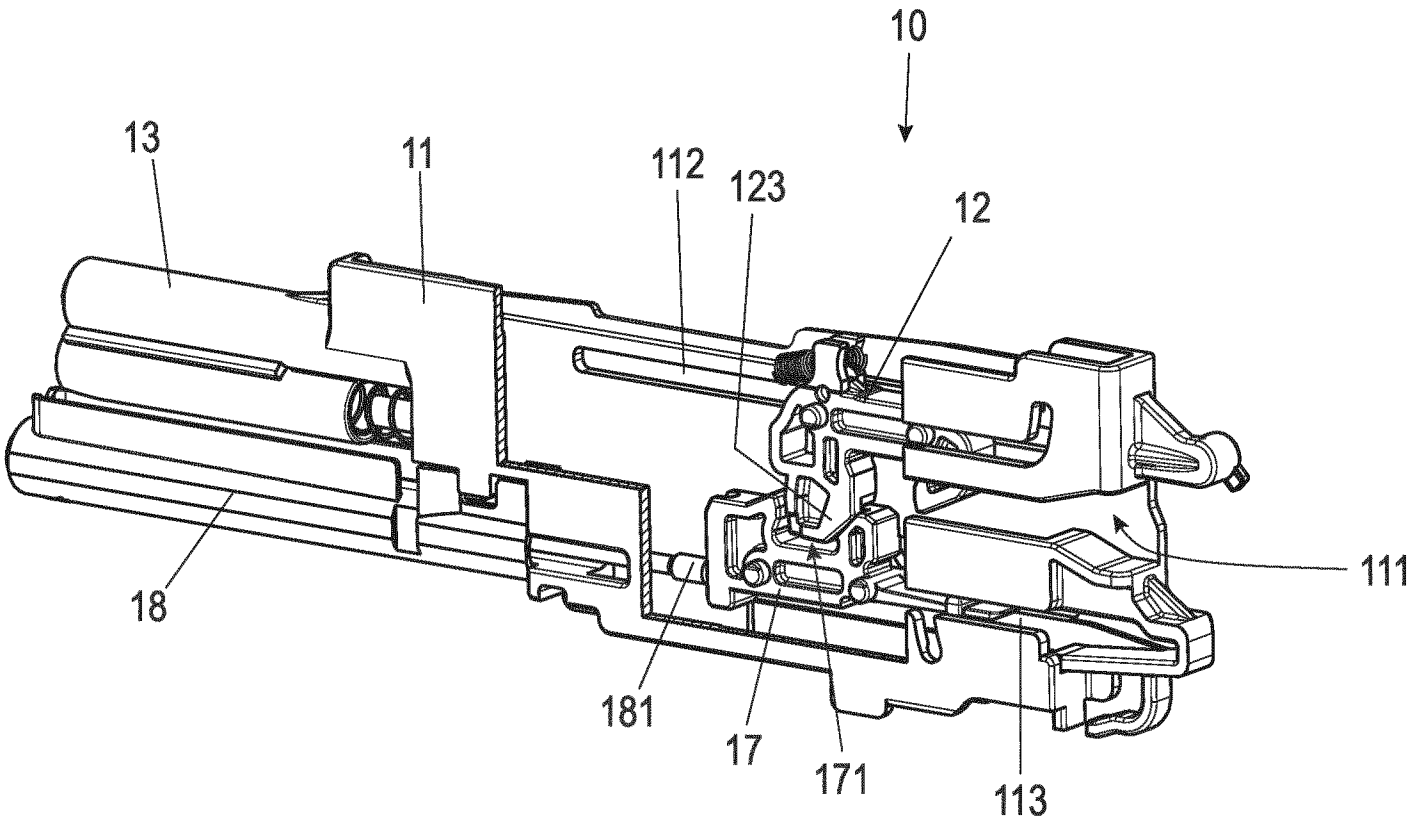

After the external activator 3 has been inserted into the driver fork 121, the first driver 12 is tilted from its rest position and moves under the force action of the energy storage unit 13 in the direction of the retracted position. An intermediate position of this movement is shown in FIG. 5*b*. The internal activator 123 is still positioned in the driver fork 171, so that the second driver 17 moves synchronously with the first driver 12 and the retraction movement is dampened.

Figure 5C:
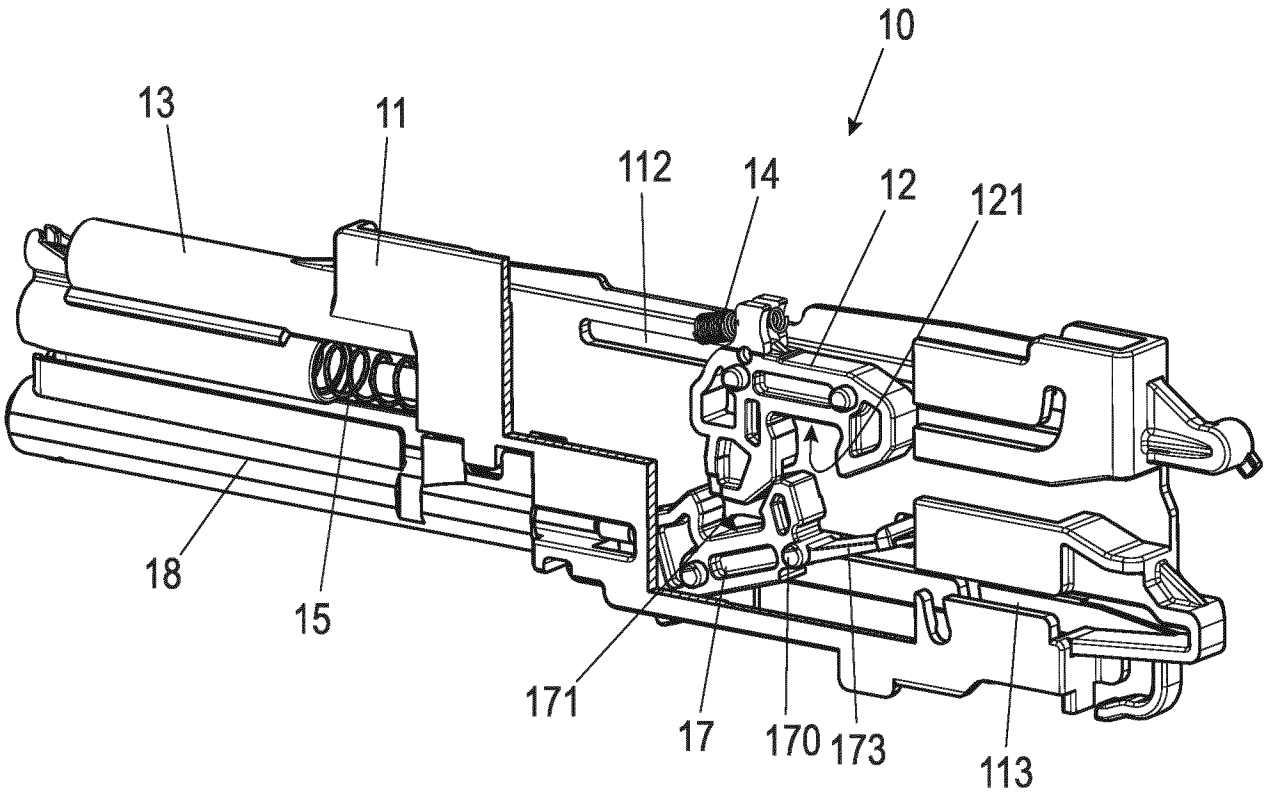

In the continued retraction movement shown in FIG. 5*c*, the second driver 17 reaches the end of its second guideway 113 in the transition region between the two sections A and B of the retraction movement, wherein the guide pin 170 advancing in the direction of movement pivots into the bent end region 113*a* (not visible in FIG. 5*c*). As a result, the second driver 17 tilts in the rear area, releasing the internal activator 123 of the first driver 12. In this case, the spring lance 173 swivels up. To enable this movement, the parking section 113 is provided, in which the guide pins of the spring lance 173 are located.

In the second section B, which now follows, the first driver 12 moves undamped under the action of the force of the energy storage unit 13 until the end of the first guideway 112 is reached. This condition is shown in FIG. 5*d*.

Figure 5D:
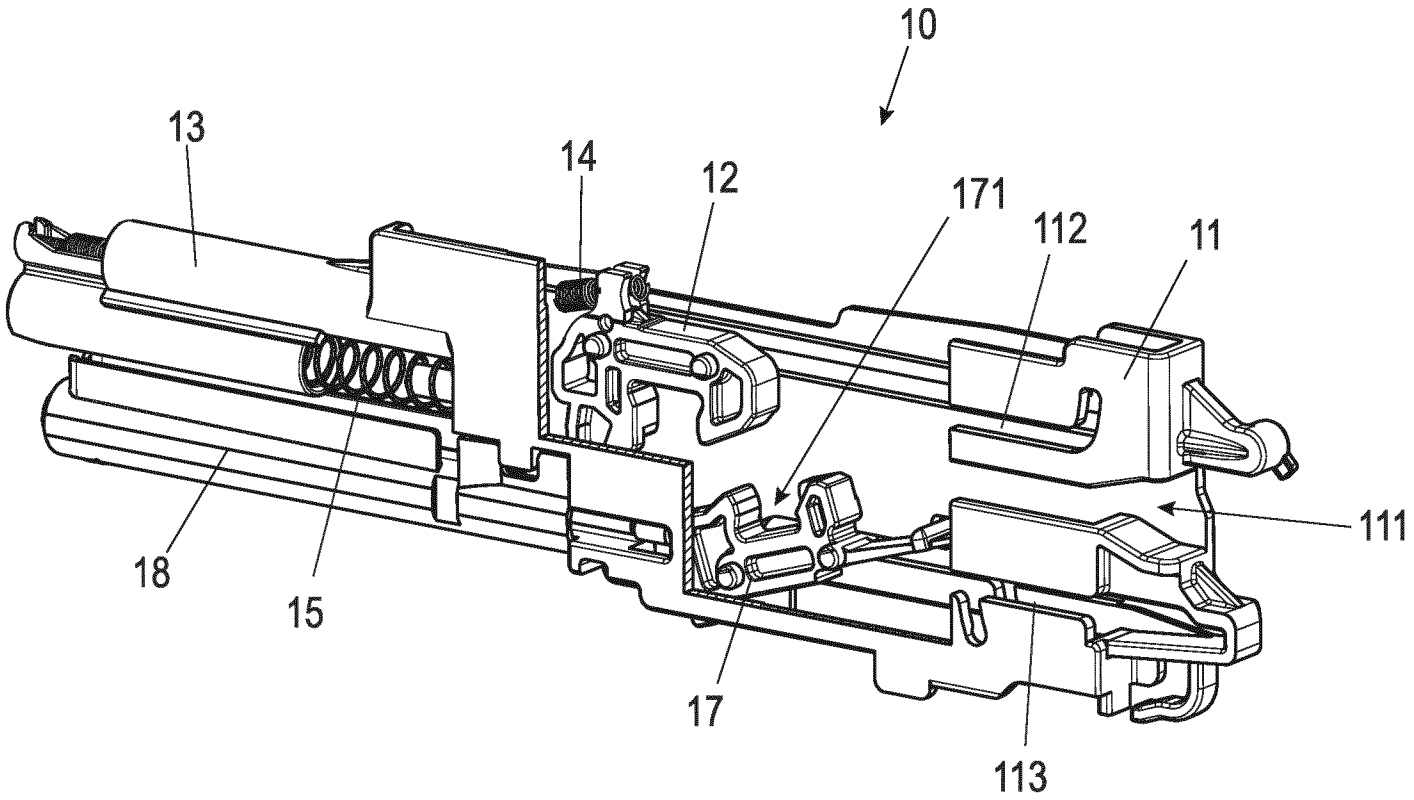

When the drawer element is extended again from the closed state according to FIG. 5*d*, the sequence shown in partial drawings 5*a*-5*d* runs backwards. At the transition between the second section B and the first section A the internal activator 123 couples into the second driver fork 171 and lifts the second driver 17 from its rear idle state.

Then both drivers 12, 17 move together in the first section A (see FIG. 3) until at the front end of the first section A the first driver 12 pivots upwardly at the front and releases the external activator 3. The self-retracting and damping device is then again in its front resting position according to FIG. 5*a*.

For transport or installation reasons, it is possible with the self-retracting and damping device 10 shown that the two drivers 12, 17 are not coupled even in the area of the first section A, but that the internal activator 123 is positioned outside the second driver fork 171.

Such a situation is depicted in FIG. 6*a* in a comparable way to FIGS. 5*a*-*d*. The internal activator 123 (in this illustration) is located to the left of the second driver fork 171. In this situation, the first driver 12 would not reach the front end of its first guideway 112, so that the activator 3 cannot be released. In order to also return to a regular operating state in the situation shown, the evasion section 113*c* is provided in the second guideway 113. As the first driver 12 continues to move toward the front end of the self-retracting and damping device 10, the internal activator 123 pushes the second driver 17 downward in its rear region, with the corresponding guide pin 170 moving into the evasion section 113*c*. The second driver 17 then tilts so far that the first driver 12 can pass.

FIG. 6*c* shows a state shortly before reaching the front stop of the first driver 12, in which the internal activator 123 is shortly before reaching the second driver fork 171. In order to ensure that the second driver 170 takes up a horizontal alignment again after passing the first driver 12, in which the guide pin 170 is positioned in the horizontal area of the guide curve 113, the spring lance 173 protruding forwards is provided on the second driver 17. When pressing down the second driver 17 at its rear end, the spring lance 173 assumes the bending position shown in FIGS. 6*b* and 6*c*. This bending position is accompanied by a restoring force for the second driver 17 to its original horizontal alignment. Accordingly, as soon as the internal activator 123 has completely reached the position of the driver fork 171, the second driver 17 in the rear area will spring back to its original position according to FIG. 5*a*, relaxing the spring lance 173. The system is then back in its correct initial operating state.

FIGS. 7*a* to 10 show a second embodiment example of a self-retracting and damping device 10. This device is intended for separate mounting inside a domestic appliance or in a furniture body, or alternatively for mounting on the drawer element or on the movable part of the furniture, wherein the external activator is then attached to the fixed part of the furniture, domestic appliance or guide. In the second embodiment example, identical reference numerals indicate elements with the same or equivalent effect as in the first embodiment example.

FIG. 7*a* shows the self-retracting and damping device 10 initially in an isometric oblique view together with an external activator 3, which is located shortly before entering the self-retracting and damping device 10.

With regard to its basic design, the self-retracting and damping device 10 of the second embodiment example is comparable to that of the first embodiment example. In the following, the differences between the two embodiments will be discussed in particular.

In the second embodiment example, the first driver 12, which receives the external activator 3 with its driver fork 121, is arranged in a lower region of the housing 11, and the second driver 17, which is coupled to the damping element 18, is arranged in an upper section of the housing 11. First and second guideways 112, 113, respectively, are again provided, which guide the first and second drivers 12, 17, respectively, on a crutch curve. Again, the first guide curve 112 has an angled end section 112*a* at the front and the second guide curve 113 has an angled end section 113*a* at the rear.

As in the first embodiment example, the two drivers 12, 17 couple in a first section A of the movement so that a damped self-retracting movement occurs. In a second section B, the second driver 17 releases the internal activator 123 from its driver fork 171, so that in the second section B there is an undamped self-retracting movement.

The coupling of the two drivers 12, 17 in the first movement section is shown in FIG. 7*b*, which shows the self-retracting and damping device 10 in the same state as FIG. 7*a* with partially cut housing 11.

Figure 8B:
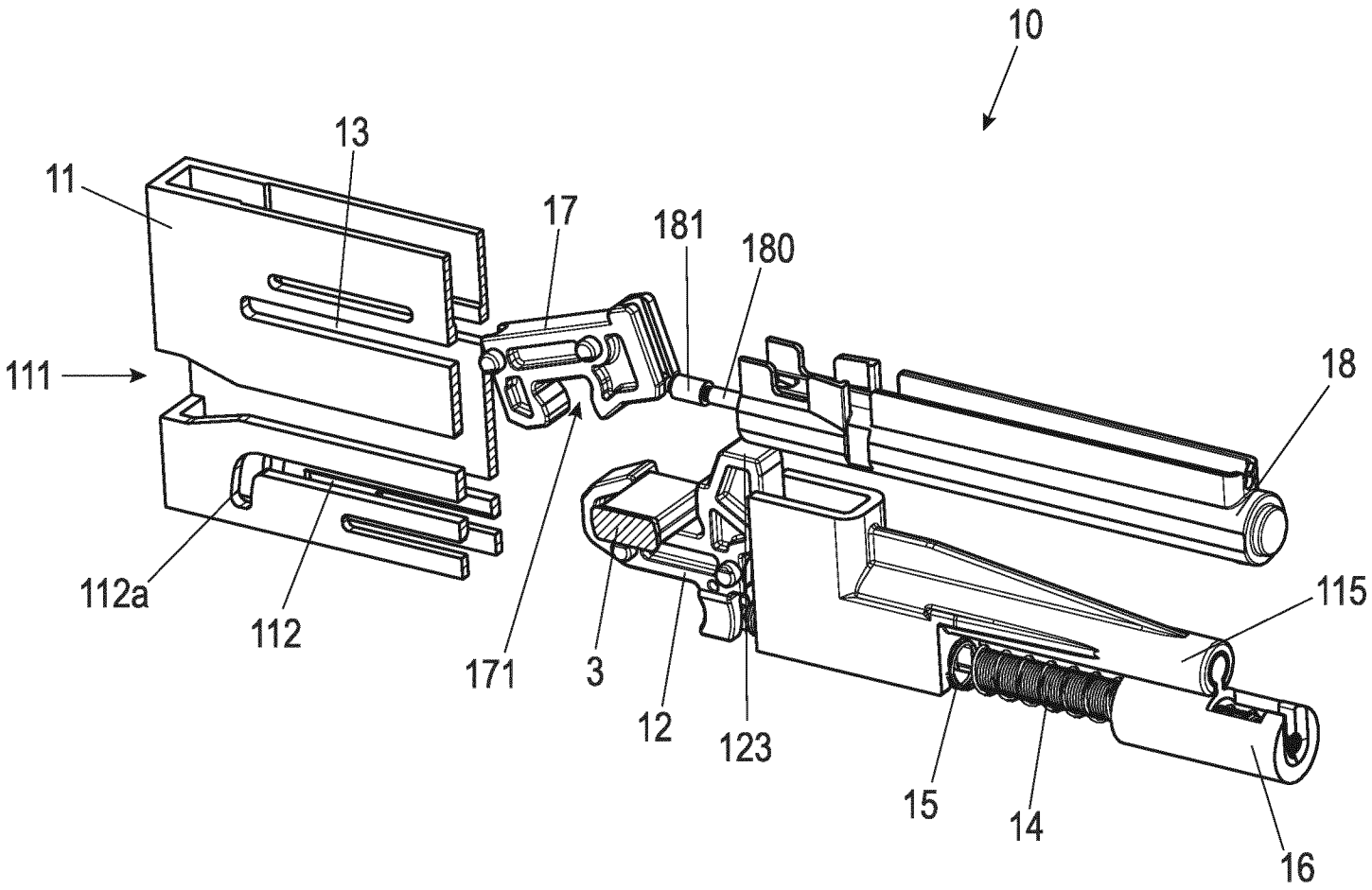

FIGS. 8*a* and 8*b* show the self-retracting and damping device 10 in the fully retracted state of the activator 3, analogous to FIGS. 7*a* and 7*b*. As can be seen from FIG. 8*b*, in the second section B the rear end of the second driver 17 is pivoted upwardly, in which the corresponding guide pin 170 enters the angled end section 113*a*. The coupling of the drivers 12, 17 is cancelled and the first driver 12 can move undamped up to its end stop.

Due to the reversed arrangement of the guideways 112, 113 compared to the first embodiment example, the second guideway 113 in the angled end section 113*a* runs upwards. Since the spring force is not applied, the second driver 17 could slip out of the end position shown in FIG. 8*a* or 8*b* due to gravity after decoupling the two drivers 12, 17.

To prevent this, a detent means 116 in the form of a resilient projection is arranged in the angled end section 113*a*, as shown in FIG. 9 in an enlarged section of the self-retracting and damping device 10 of the second design example. In the end position, the guide pin 170 remains above the detent means 116. Under the action of force, however, once the coupling with the first driver 12 has been restored, the guide pin 170 can easily slide over the detent means 116 and be moved out of the end position. In order to achieve the resilient effect of the detent means 116, an incision 117 is made in the wall of the housing 11 around the angled end section 113*a*.

As can be seen especially in FIG. 8*a*, the energy storage unit 13 in the second embodiment example is also realized by a combination of a tension spring 14 and a compression spring 15. In turn, a coupling carriage 16 is present, which is guided in a section of the housing 11 formed as sleeve 115.

FIG. 10 shows the structure of the self-retracting and damping device 10 in an isometric exploded view as an overview in accordance with the second embodiment example. In contrast to the first embodiment example, the tension spring 14 of the second embodiment example extends within the compression spring 15. FIG. 10 shows that the coupling carriage 16 has only a tubular receptacle for both the compression spring 15 and the tension spring 14 guided therein, and in the upper region a likewise elongated pin 163, which is guided in the sleeve 115.

There is a further difference between the two embodiment examples with regard to an operating state in which the internal activator 123 is not positioned in the driving fork 171 even in the first movement section (see FIGS. 6*a* to 6*c* and associated description). In the present case, re-engagement of the internal activator 123 into the driving fork 171 is made possible by at least one edge (in the present case the upper edge) of the second guide curve 113 being resilient and elastic in its front region and thus offering a certain freedom of movement for the guide pin 170. This is achieved by making an incision 118 parallel to the second guide curve 113, which allows the second driver 17 to move upwards so far that the first driver 12 can pass with its internal activator 123. As shown below, comparable incisions 119 can be made in support of the first guide curve 121. These allow the first driver 12 to move downwards accordingly.

In connection with FIGS. 11 and 12, examples of a piece of furniture or domestic appliance in which a self-retracting and damping device 10 is used in accordance with the application are shown below.

FIG. 11 shows in an isometric sectional view a partial view of a body 4 of a piece of furniture in form of a cabinet as an example. A pull-out guide facing the interior 6 of body 4 is arranged on one side wall 5 of body 4. The pull-out guide is similar to that shown in FIG. 1*a*, 1*b* or 2. It comprises a body rail 1, which is attached to the side wall 5 via mounting bracket 2.

A self-retracting and damping device 10 is also attached to the side wall 5 between the mounting brackets. The self-retracting and damping device 10 essentially corresponds to the self-retracting and damping device 10 of the first embodiment example shown in FIGS. 1*a*-6*b*. However, the difference is that no fastening is provided on the mounting brackets 2, but directly on the side wall 5. For example, screw holes in the housing 11 of the self-retracting and damping device 10 can be provided for fastening. The guide rail 1 shown here, together with a running rail not shown here, serves to guide a drawer element, for example a drawer, horizontally. An external activator is mounted on the drawer or running rail 3 which cooperates with the self-retracting and damping device 10 in the manner described above.

FIG. 12 shows the use of a self-retracting and damping device 10 in an interior space 6 of a body 4 of a refrigeration appliance. As an example, FIG. 12 shows an isometric view of a combined refrigerator and freezer, wherein the self-retracting and damping device 10 is mounted in the upper partially shown interior space 6 on a side wall 5 of the body 4. Body 4 is an insulating body of the refrigeration appliance, the front face of which is provided with a circumferential insulating seal 7.

The pull-out guide shown corresponds in turn to that shown in FIGS. 1*a*, 1*b* and 2 and includes a running rail 1 which is mounted on the side wall 5 via mounting bracket 2. In the case shown, a full-extension pull-out guide has been realized which comprises two further rails 8, namely a middle rail and a running rail. In addition, a synchronization unit 9 in the form of a cable pull is arranged on the pull-out guide, which ensures synchronous movement of body rail 1 and the other rails 8 relative to each other.

The self-retracting and damping device 10 corresponds to that of the first embodiment example and, as shown in connection with FIGS. 1*a*, 1*b* and 2, is attached to the front of the mounting bracket 2.

It interacts with an external activator which is not visible here and which is arranged on one of the other rails 8, preferably the running rail. Alternatively, as with the furniture shown in FIG. 11, the self-retracting and damping device 10 can be arranged on the drawer element and interact with an external activator which is fixed relative to body 4.

The advantage of the self-retracting and damping device 10 when used in a refrigerating unit is that it ensures that the drawer element guided by the pull-out guide can be retracted safely. In this way, it is reliably prevented that a door of the refrigeration unit not shown here is in contact with a drawer element that may not be fully retracted and does not close properly.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Body rail
2 Mounting bracket
3 External activator
4 Body
5 Side wall
6 Interior space
7 Door seal
8 Additional rail
9 Synchronization unit
10 Self-retracting and damping device
11 Housing
110 Fastening means
111 Incision
112 First guide curve
112*a* Angled end section
113 Second guide curve
113*a* Angled end section
113*b* Parking section
113*c* Evasion section
114 Channel
115 Sleeve
116 Detent means
117 Incision
118 Incision
119 Incision
12 First driver
120 Guide pin
121 Driver fork
122 Fork for spring
123 Internal activator
13 Energy storage unit
14 Tension spring
140 Spring head
15 Compression spring
16 Coupling carriage
160 Tension spring guide
161 Fork for spring
162 Compression spring receptacle
163 Pin
17 Second driver
170 Guide pin
171 Driver fork
172 Receptacle for ball head
173 Spring lance
18 Damping element
180 Piston rod
181 Ball head
A First section
B Second section

The invention claimed is:

1. A self-retracting and damping device for a drawer element, wherein the self-retracting and damping device is configured to engage with an external activator, and wherein the self-retracting and damping device comprises:

a first driver having a first driver fork configured for engagement of the external activator and which is displaceably guided in a first guide curve; and a second driver, which is displaceably guided in a second guide curve, wherein one of the drivers is coupled to a damping element and the other of the drivers is coupled to an energy storage unit, wherein the two drivers are coupled together in part, the first driver is coupled to the energy storage unit and the second driver is coupled to the damping element, the self-retracting and damping device is configured to have a retracting movement between an extended position of the self-retracting and damping device and a retracted position of the self-retracting and damping device, the retracting movement of the self-retracting and damping device comprises first and second sections of the retracting movement from the extended position to the retracted position of the self-retracting and damping device, the second section of the retracting movement following the first section of the retracting movement, in the first section of the retracting movement the energy storage unit and the damping element are configured to act on the external activator and in the second section of the retracting movement only the energy storage unit is configured to act on the external activator, wherein a completely retracted position of the first driver and thus of the external activator lies within the second section.

2. The self-retracting and damping device of claim 1, wherein the first driver includes an internal activator, the second driver has a second driver fork for cooperating with the internal activator in order to couple the first and second drivers to one another.

3. The self-retracting and damping device of claim 2, wherein in the first section the first driver engages with its internal activator in the second driver fork of the second driver in order to couple the two drivers, and at an end of the first section the second driver is guided through the second guide curve in such a way that the first and second drivers are uncoupled.

4. The self-retracting and damping device of claim 3, wherein the second guide curve has an angled end section in a transition region between the first and second section, wherein the angled end section faces away from the first guide curve.

5. The self-retracting and damping device of claim 4, wherein a detent means is arranged in the region of the angled end section, which detent means fixes the second driver in the end section.

6. The self-retracting and damping device of claim 1, wherein the energy storage unit has at least one tension spring and/or at least one compression spring.

7. The self-retracting and damping device of claim 6, wherein the energy storage unit has a tension spring and a compression spring connected to one another via a coupling carriage which is guided displaceably on a housing of the self-retracting and damping device.

8. The self-retracting and damping device of claim 1, wherein a length of the second section is between 30% and 35% of a total displacement path of the first driver.

9. The self-retracting and damping device of claim 1, wherein the damping element is a linear damper.

10. The self-retracting and damping device of claim 1, wherein the second guide curve has at least one evasion section extending obliquely with respect to a main guide direction to enable an evasive movement of the second driver in a direction transverse to the main guide direction.

11. The self-retracting and damping device of claim 10, wherein the second driver has a spring lance projecting into its travel path and exerts a restoring force on the second driver during the evasive movement.

12. The self-retracting and damping device of claim 1, wherein at least one edge of the second guide curve is flexible in sections in order to enable an evasive movement of the second driver in a direction transverse to a main guide direction.

13. The self-retracting and damping device of claim 12, wherein the second guide curve is formed in a wall of a housing of the self-retracting and damping device, wherein an incision is present in sections in the wall adjacent to the second guide curve.

14. A piece of furniture or a domestic appliance, comprising:

at least one drawer element;

an external activator; and a self-retracting and damping device coupled to the at least one drawer element, wherein the self-retracting and damping device comprises a first driver having a first driver fork configured for engagement of the external activator and which is displaceably guided in a first guide curve; and a second driver, which is displaceably guided in a second guide curve, wherein one of the drivers is coupled to a damping element and the other of the drivers is coupled to an energy storage unit, wherein the two drivers are coupled together in part, the first driver is coupled to the energy storage unit and the second driver is coupled to the damping element, the self-retracting and damping device is configured to have a retracting movement between an extended position of the self-retracting and damping device and a retracted position of the self-retracting and damping device, the retracting movement of the self-retracting and damping device comprises first and second sections of the retracting movement from the extended position to the retracted position of the self-retracting and damping device, the second section of the retracting movement following the first section of the retracting movement, in the first section of the retracting movement the energy storage unit and the damping element are configured to act on the external activator and in a second section of the retracting movement only the energy storage unit is configured to act on the external activator, wherein a completely retracted position of the first driver and thus of the external activator lies within the second section.

* * * * *